US007285915B2

(12) United States Patent
Mako et al.

(10) Patent No.: US 7,285,915 B2
(45) Date of Patent: Oct. 23, 2007

(54) ELECTRON GUN FOR PRODUCING INCIDENT AND SECONDARY ELECTRONS

(76) Inventors: Frederick Michael Mako, 6308 Youngs Branch Dr., Fairfax Station, VA (US) 22039; William Kalman Peter, 11902 Bargate Ct., Rockville, MD (US) 20852

( * ) Notice: Subject to any disclaimer, the term of this patent is extended or adjusted under 35 U.S.C. 154(b) by 400 days.

(21) Appl. No.: 09/995,077

(22) Filed: Nov. 26, 2001

(65) Prior Publication Data

US 2003/0038603 A1 Feb. 27, 2003

Related U.S. Application Data

(63) Continuation of application No. 08/348,040, filed on Dec. 1, 1994, now abandoned.

(51) Int. Cl.
*H01J 25/76* (2006.01)

(52) U.S. Cl. ..... 315/5.12; 315/5.33; 313/104; 327/301

(58) Field of Classification Search ..... 315/4, 315/5, 5.11, 5.12, 5.33, 5.34, 5.35, 5.39; 313/103 R, 104; 331/79; 327/301
See application file for complete search history.

*Primary Examiner*—Benny T. Lee
(74) *Attorney, Agent, or Firm*—Ansel M. Schwartz

(57) ABSTRACT

An electron gun. The electron gun includes an RE cavity having a first side with an emitting surface and a second side with a transmitting and emitting section. The gun also includes a mechanism for producing an oscillating force which encompasses the emitting surface and the section so electrons are directed between the emitting surface and the section to contact the emitting surface and generate additional electrons and to contact the section to generate additional electrons or escape the cavity through the section. A method for producing electrons.

7 Claims, 46 Drawing Sheets

Schematic of rf gun operating in $TM_{020}$ mode.

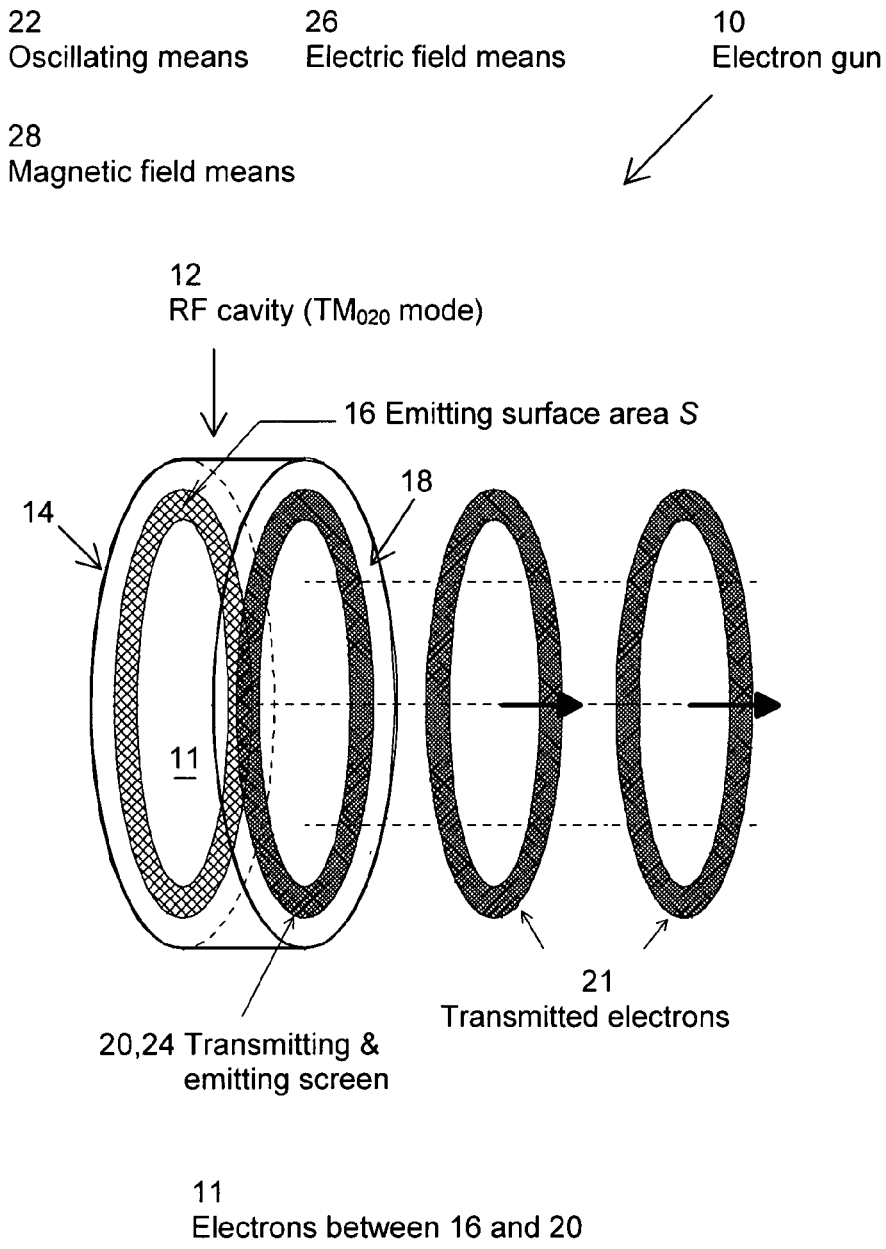
Figure 1: Perspective view of the micropulse gun for a hollow beam in the $TM_{020}$ mode. The inner conductor is not shown.

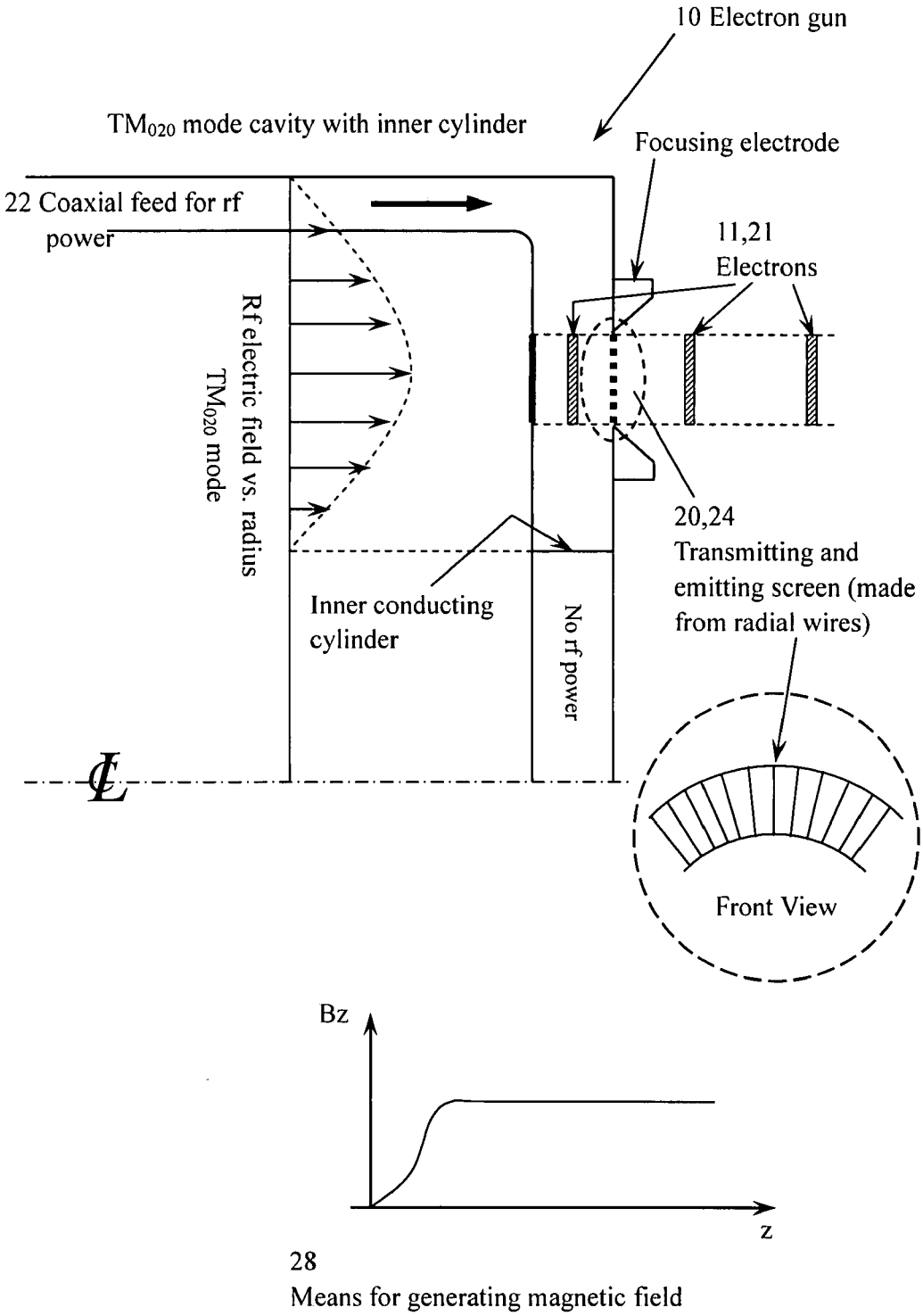
Figure 2: Schematic of rf gun operating in $TM_{020}$ mode.

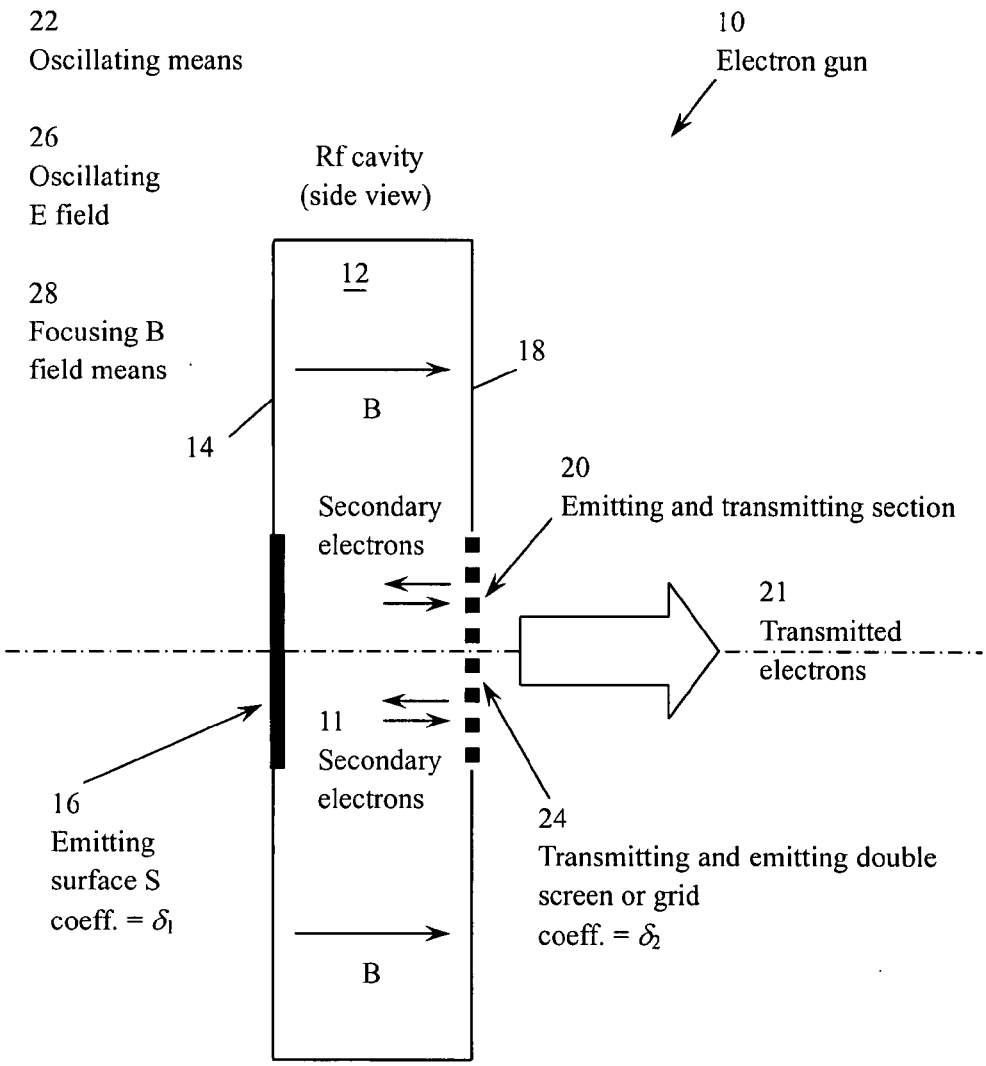
Figure 3: Schematic of micropulse gun for solid beam ($TM_{010}$) mode. A coaxial feed is used for rf input (not shown).

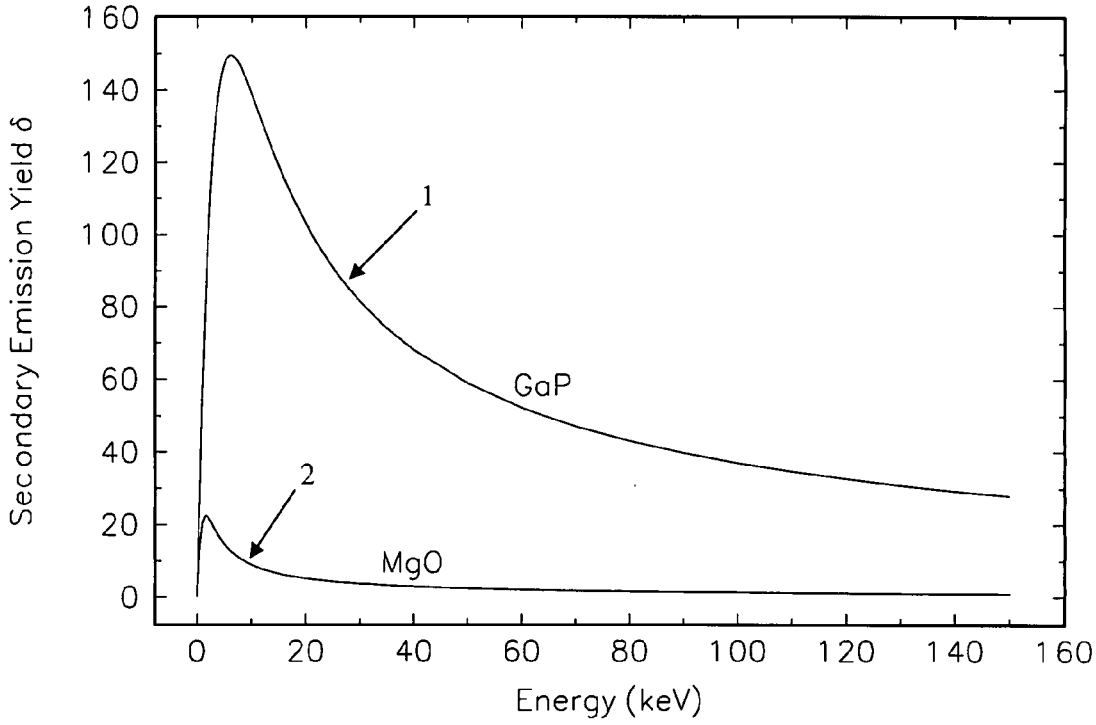
1 – Secondary emission yield of GaP
2 – Secondary emission yield of MgO
Figure 4: Secondary electron emission yield curve for GaP and MgO.

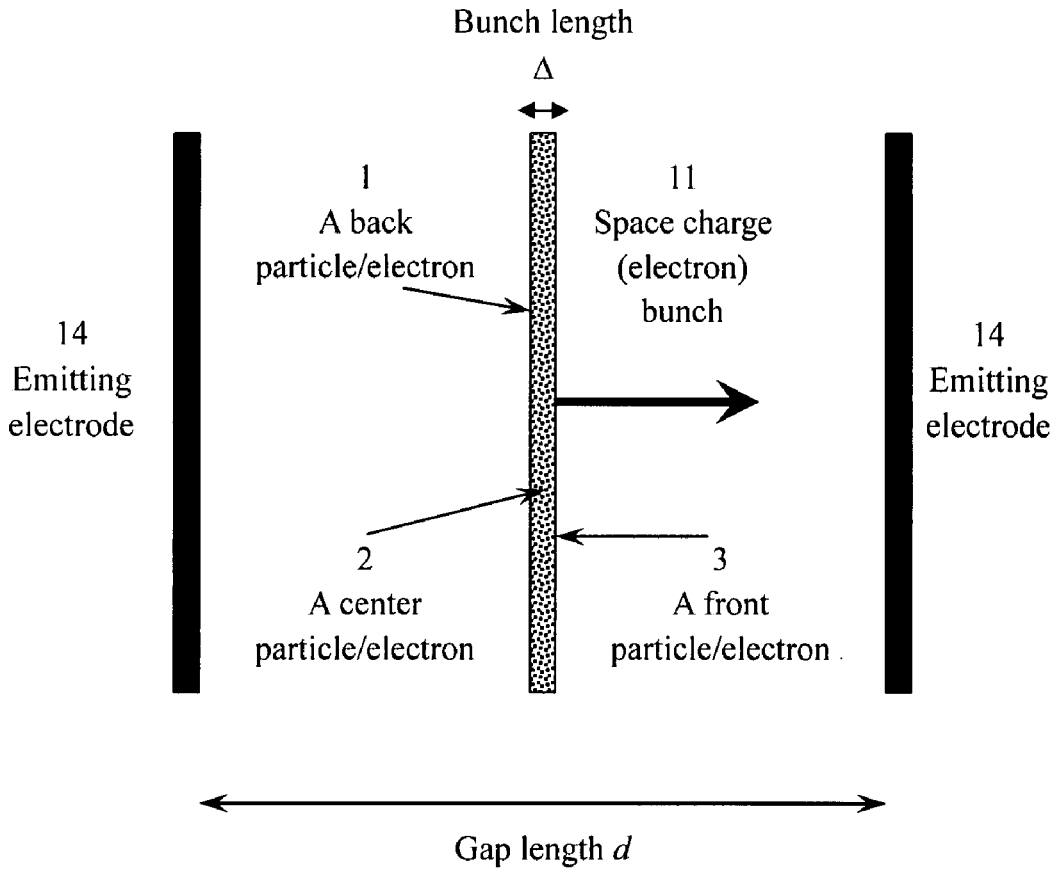
14 - Emitting electrodes
11 - Electron bunch
1 - A back particle/electron
2 - A center particle/electron
3 - A front particle/electron
Figure 5. Schematic drawing of model used in theoretical analysis.

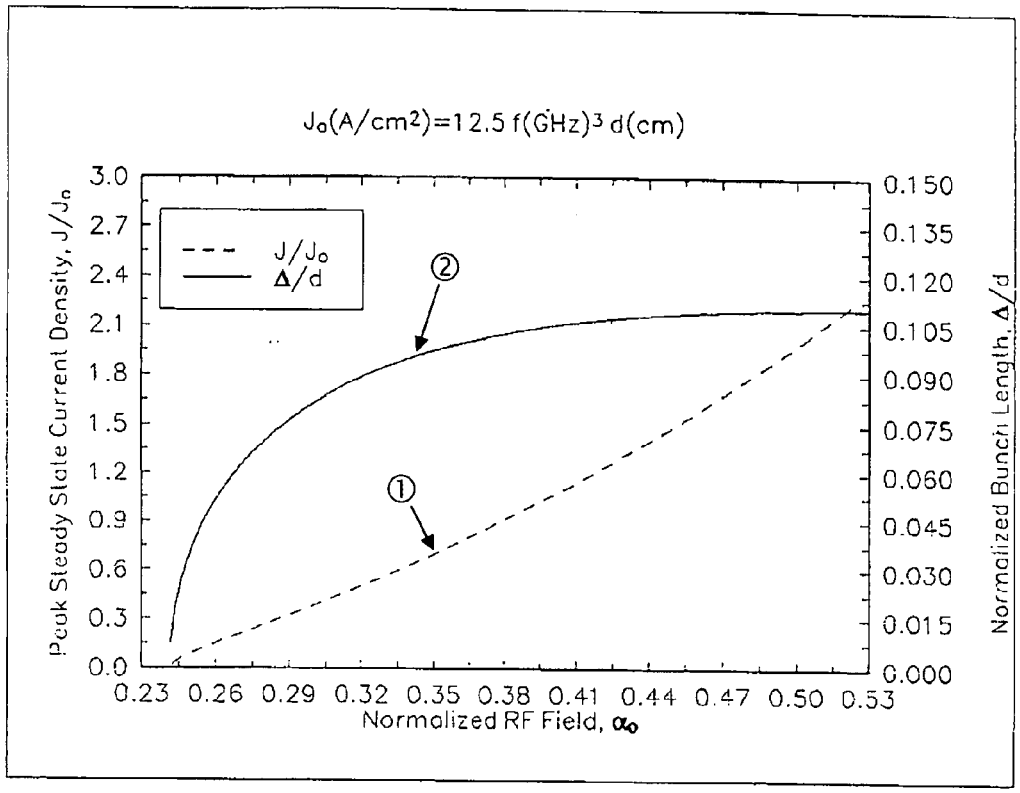
① Plot of normalized peak current density at steady state versus rf field.
② Plot of normalized electron bunch length versus rf field.
Figure 6: Steady-state current density and bunch length vs. rf field, all parameters are normalized.

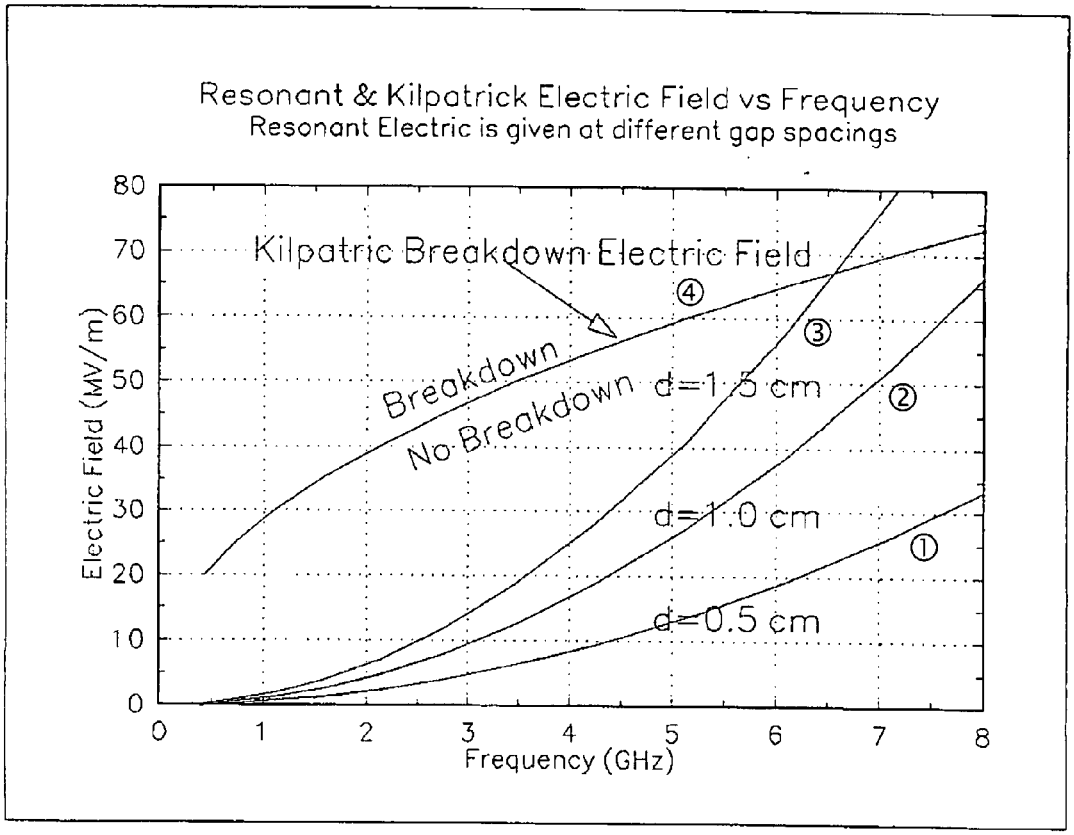

① Plot of resonant electric field versus frequency for 0.5 cm gap
② Plot of resonant electric field versus frequency for 1.0 cm gap
③ Plot of resonant electric field versus frequency for 1.5 cm gap
④ Plot of Kilpatrick breakdown electric field versus frequency.

Figure 7: Plot of resonant electric fields for $\alpha_0 = 0.453$ and various gap spacings. Also shown is the critical Kilpatrick electric field as a function of rf frequency.

1.3 GHz, xy plot

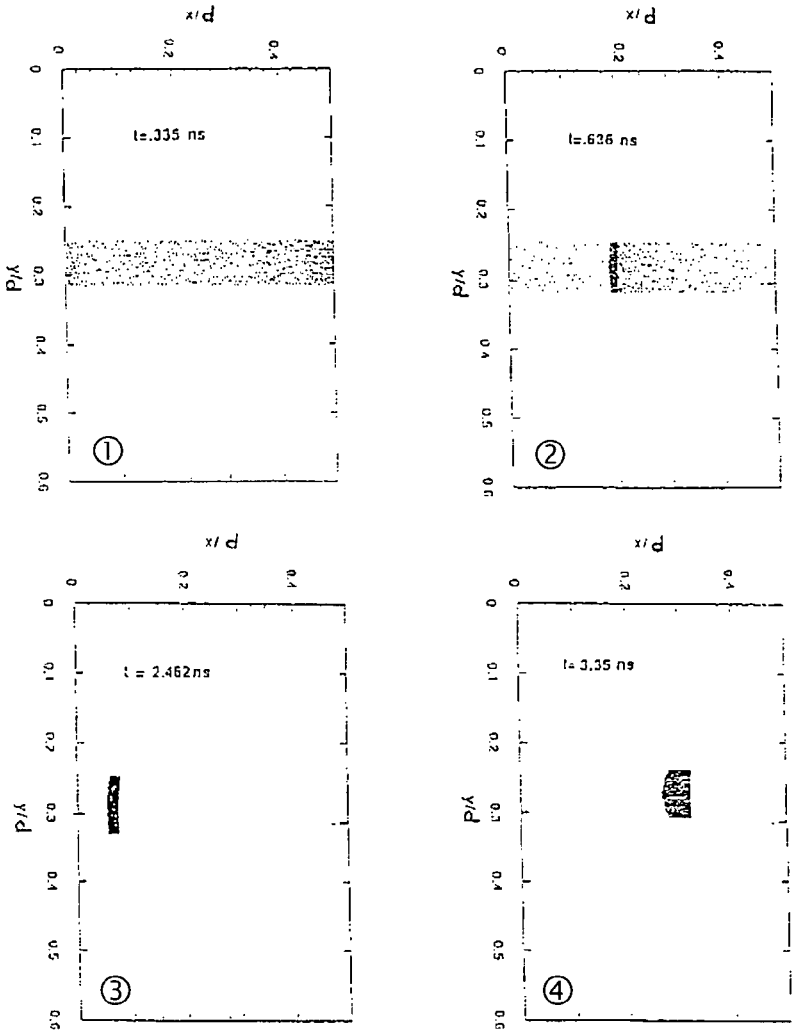

① Plot of electron distribution in the cavity at t = 0.335 ns.
② Plot of electron distribution in the cavity at t = 0.636 ns.
③ Plot of electron distribution in the cavity at t = 2.462 ns.
④ Plot of electron distribution in the cavity at t = 3.35 ns.

Figure 8: Series of time "snapshots" for a 1.3 GHz, $d = 0.5$ cm cavity using the two-dimensional PIC code with secondary emission. Note the rapid particle build-up and bunching by phase selection. Electrons traverse the horizontal axis. On the vertical axis, emission is limited to the region 0.25 to 0.32 cm.

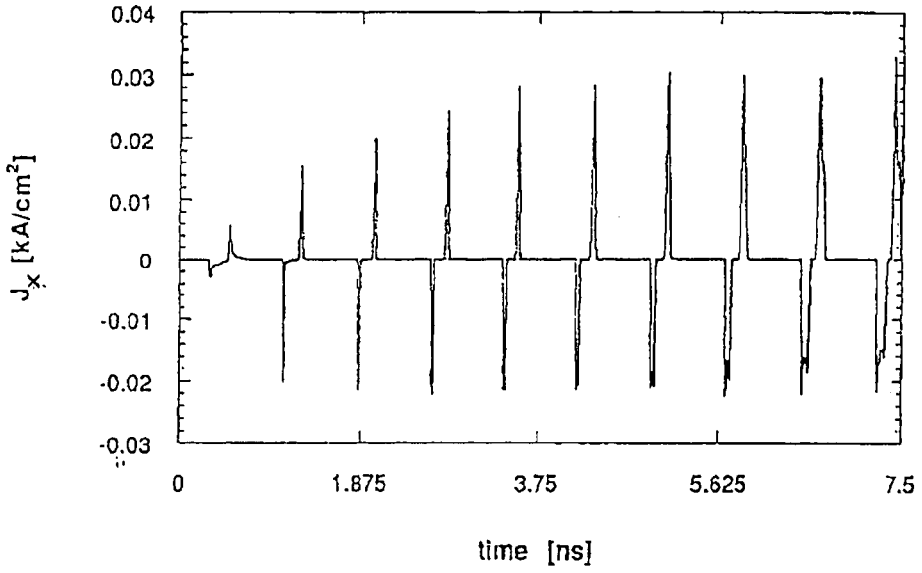
Figure 9: Plot of current density vs. time for simulation with rf frequency 1.3 GHz, voltage amplitude 4.3 kV, $d$ = 0.5 cm, and $\alpha_0$ =0.453.

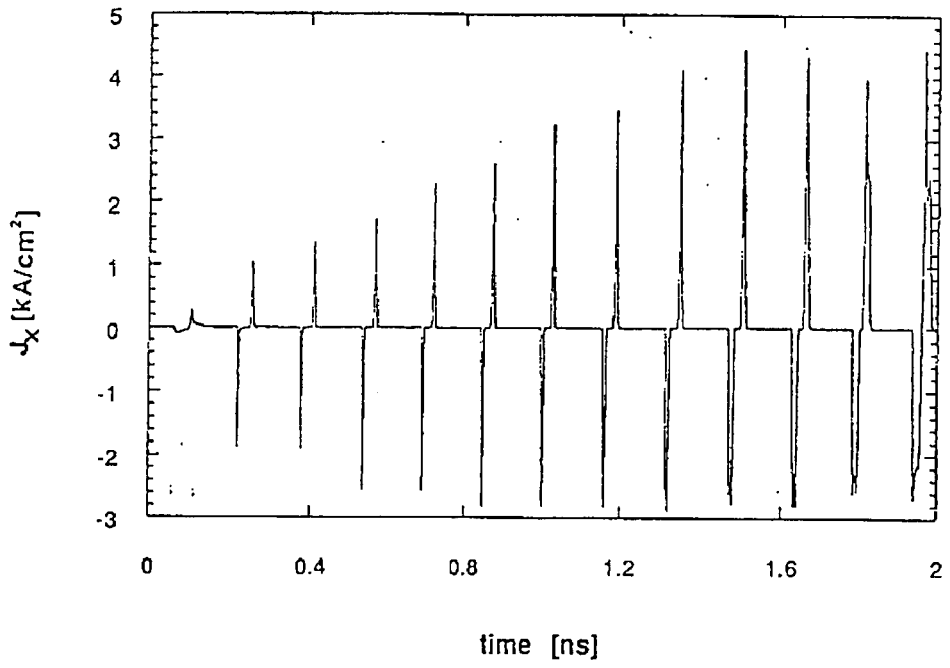
Figure 10: Plot of current density vs. time for simulation with rf frequency 6.4 GHz, voltage amplitude 105 kV, $d = 0.5$ cm, and $\alpha_0 = 0.453$.

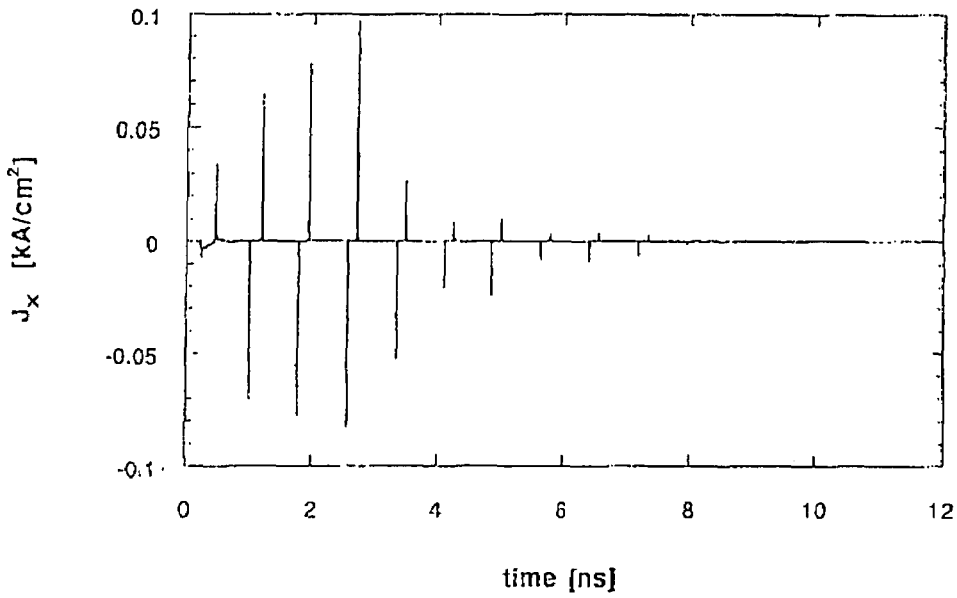
Figure 11: Current density in kA/cm$^2$ for an off-resonance $d = 0.5$ cm cavity with frequency 1.3 GHz and higher voltage 9.8 kV. Note that not only does current amplification not occur, but the steady-state current is zero.

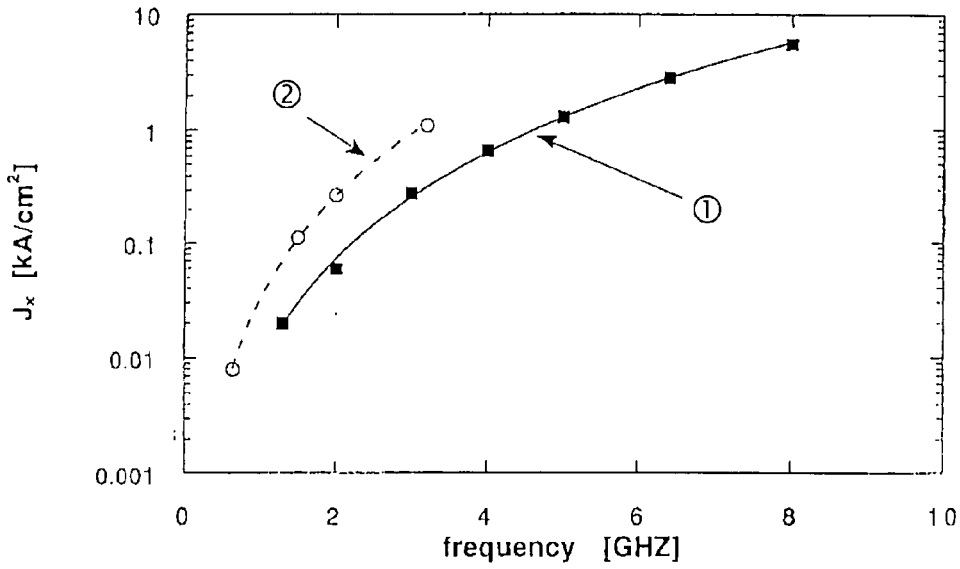
Figure 12: Steady-state current density vs. rf frequency for cavity with $\alpha_0 = 0.453$ and gap lengths of ① 0.5 cm (solid line is a fit using $J_x = 0.008f^{3.15}$) and ② 1.0 cm (dashed line is a fit using $J_x = 0.03f^{3.1}$).

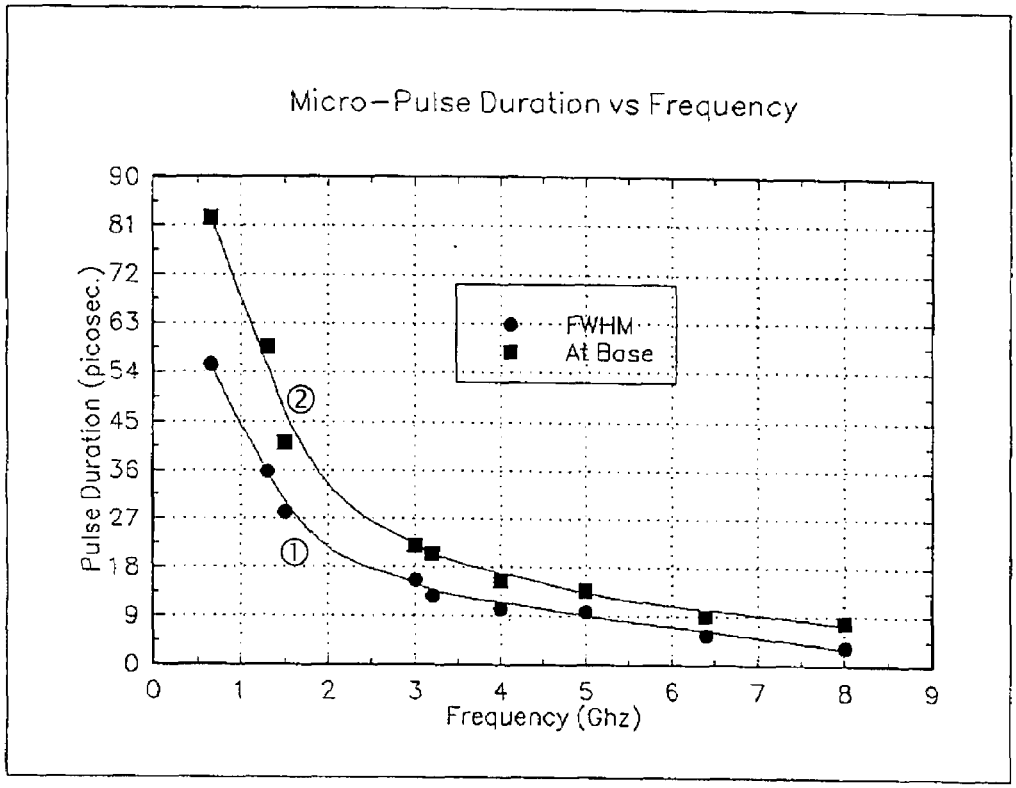
① Electron micro-pulse full width at half maximum.
② Electron micro-pulse full width at the base of the pulse.
Figure 13: Micro-pulse duration vs. frequency for $\alpha_0 = 0.453$.

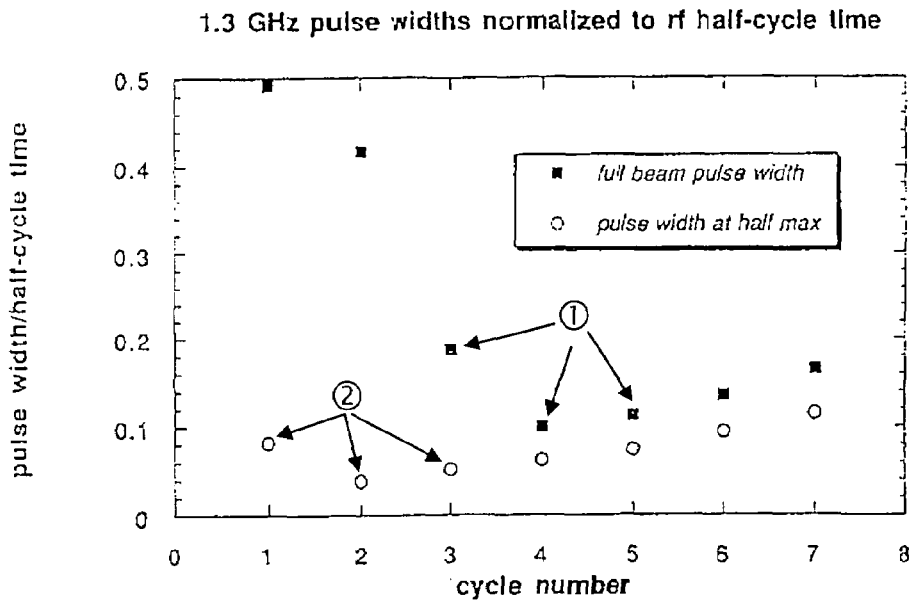

① (solid square) Beam full width at different rf cycle.

② (open circle) Beam full width at half maximum at different rf cycle.

Figure 14: Micro-pulse width (as a fraction of the half-cycle) vs. rf cycle number near the output grid. The full beam pulse width decreases with time, and reaches a minimum at the fourth rf cycle. After saturation there is a slight increase in pulse-width due to space-charge effects.

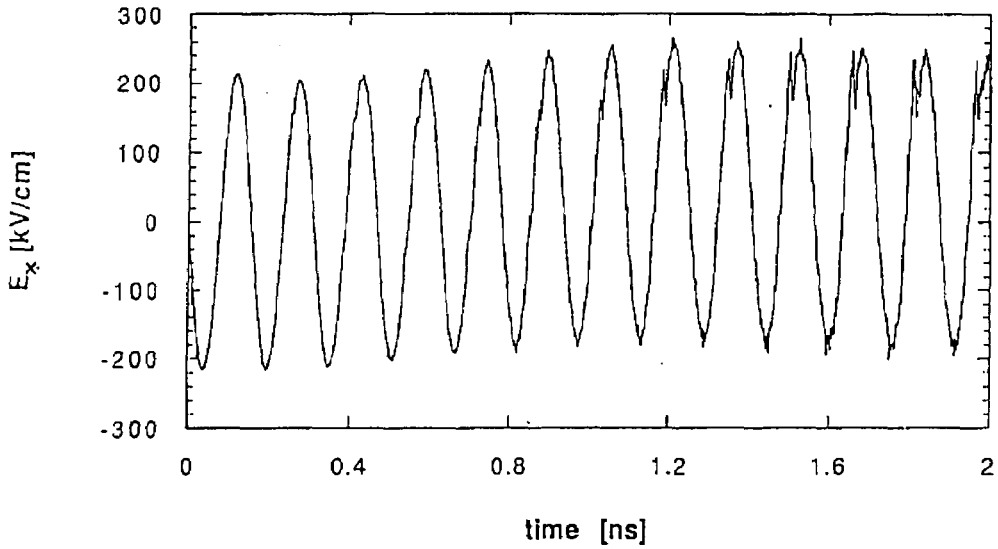
Figure 15: Longitudinal electric field in kv/cm as measured by a probe near the exit grid for the 6.4 GHz, 105 kV simulation.

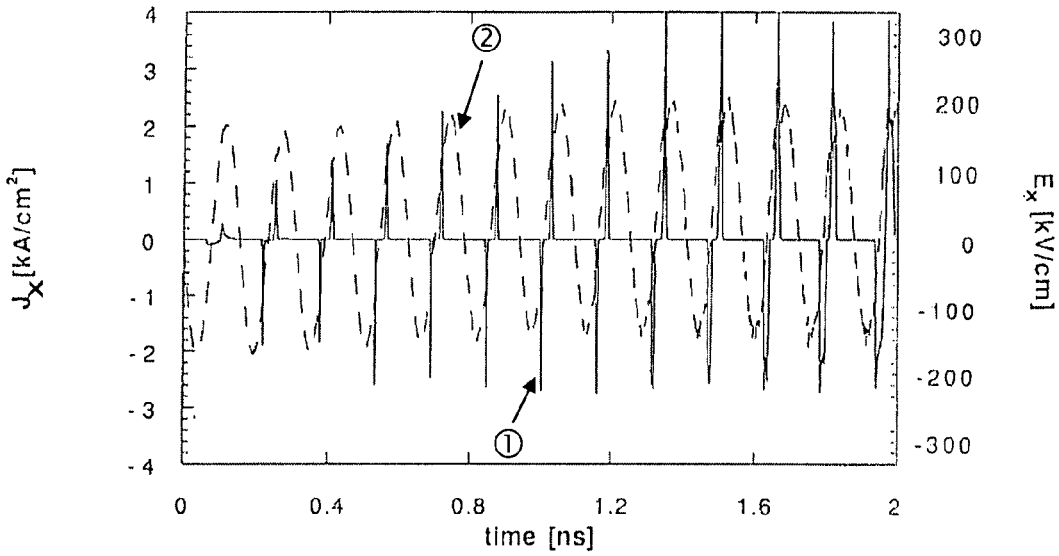
Figure 16: ① Plot of the current density in kA/cm$^2$ (solid line) and ② the longitudinal electric field (dashed line) for the 6.4 GHz, 105 kV simulation.

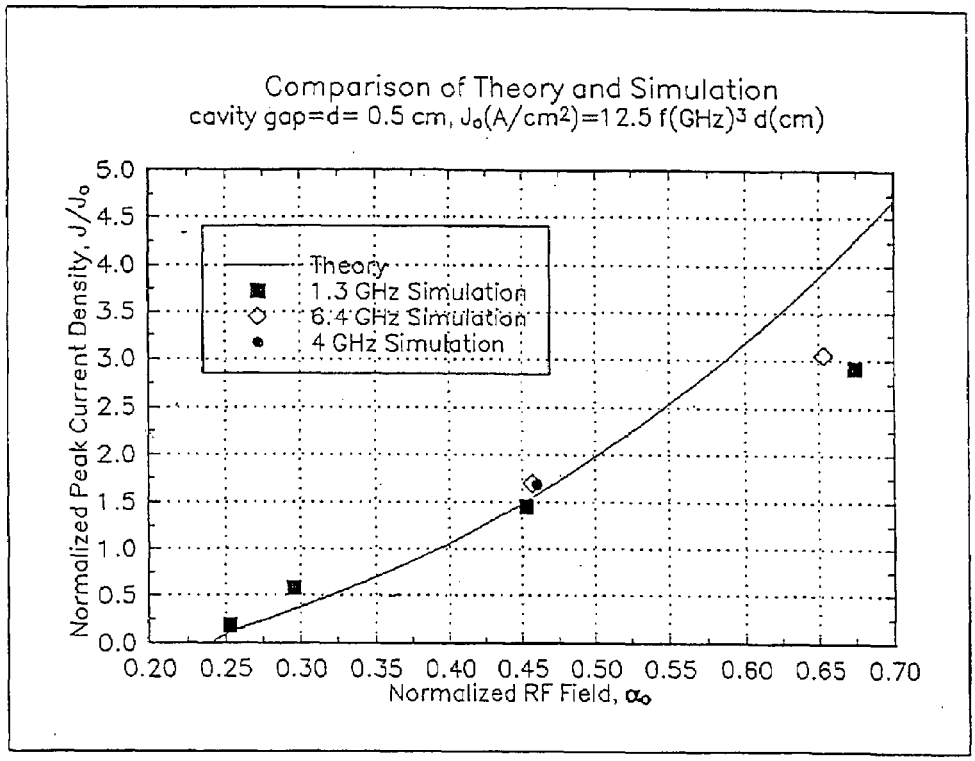
Figure 17: Resonant Tuning Curve (both simulation and theory) showing the tolerance of the micropulse electron gun.

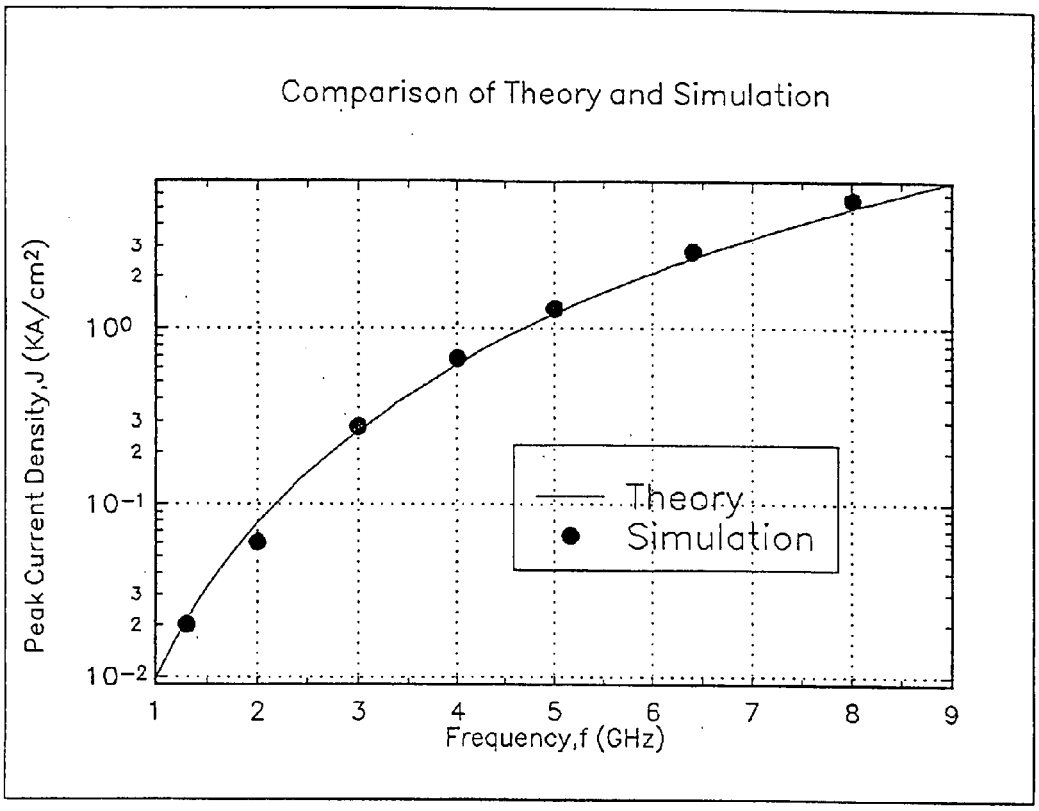
Figure 18: Comparison of peak current density in kA/cm$^2$ versus frequency for simulation and theory for a gap length of 0.5 cm and drive parameter $\alpha_0 = 0.453$.

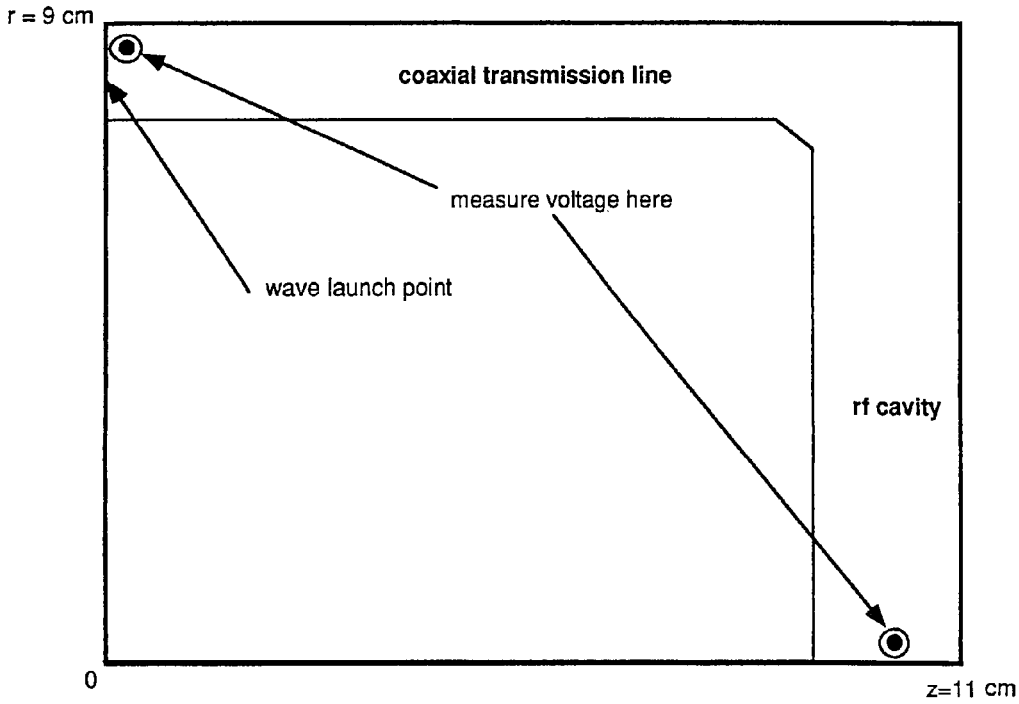
Figure 19: Side view of a cylindrically symmetric coaxial transmission line and cavity. An rf wave is launched at the left end of the coaxial line.

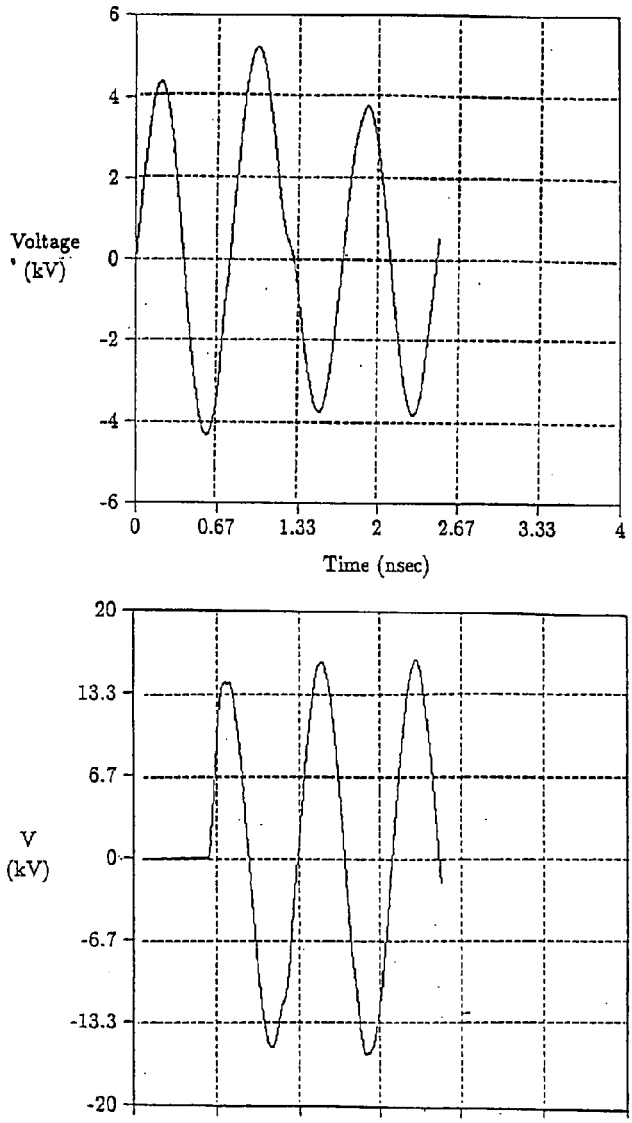
Figure 20: Resulting voltages for a $TM_{010}$ cavity at 1.275 GHz (9 cm radius) with a one cm cavity gap and one cm coaxial gap. (top) voltage measured at entrance of coax, and (bottom) voltage measured at cavity center.

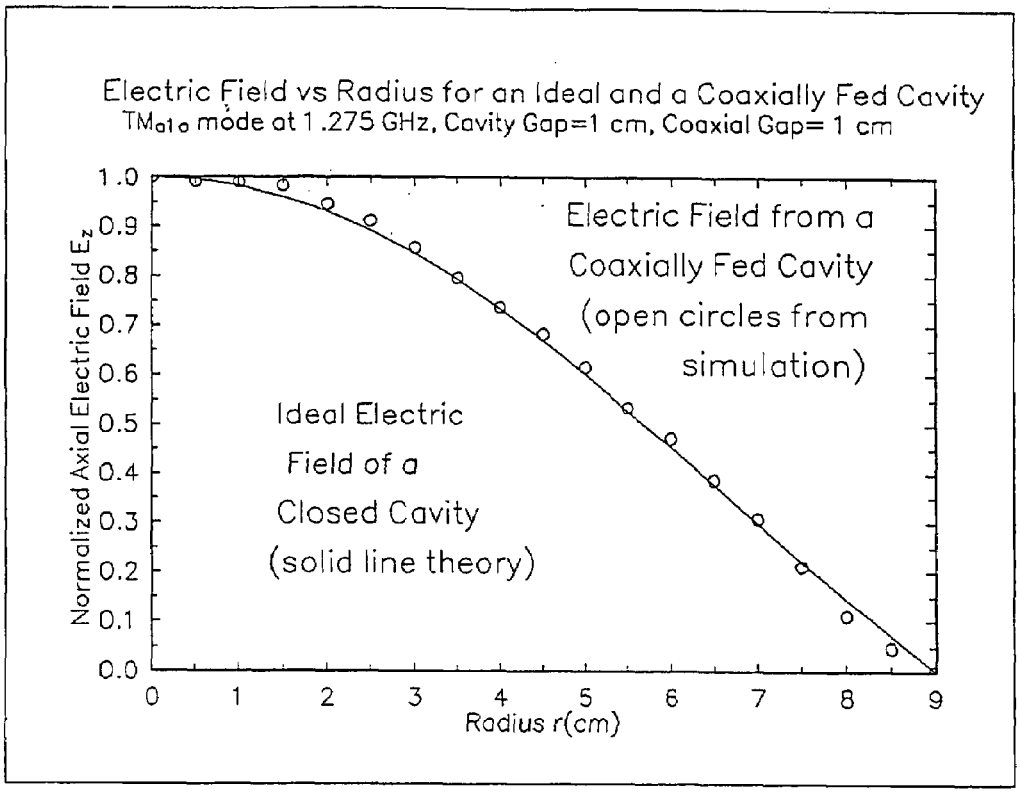
Figure 21: Electric field from a coaxially fed cavity ($TM_{010}$ mode) showing simulation values (open circles) and theoretical curve for an ideal closed cavity.

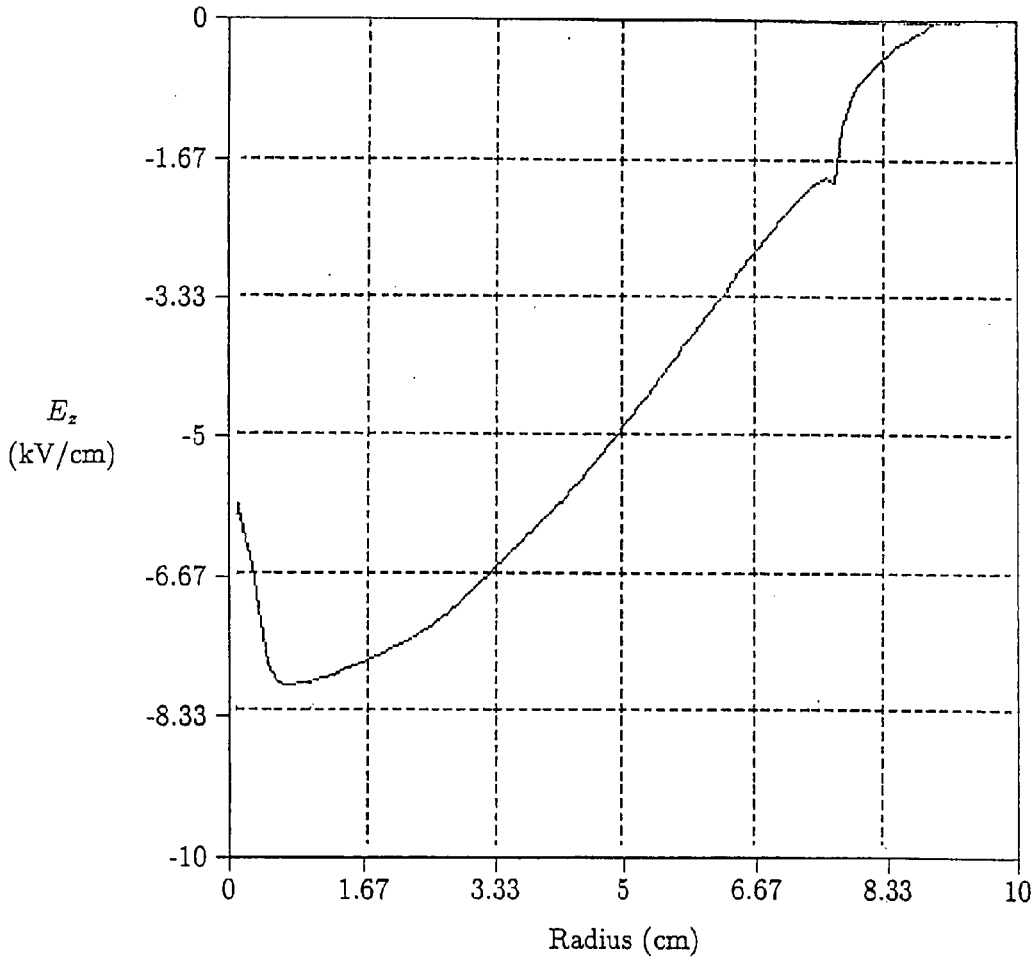
Figure 22: Axial electric field in cavity with a one cm diameter, 40 amp/cm$^2$, 25 ps long beam emitted into the cavity. The curve is inverted compared to the plot of Fig. 21. However, the depression at $R = 0$ cm due to space charge is clearly seen. Beam loading reduces the field by about 1/3.

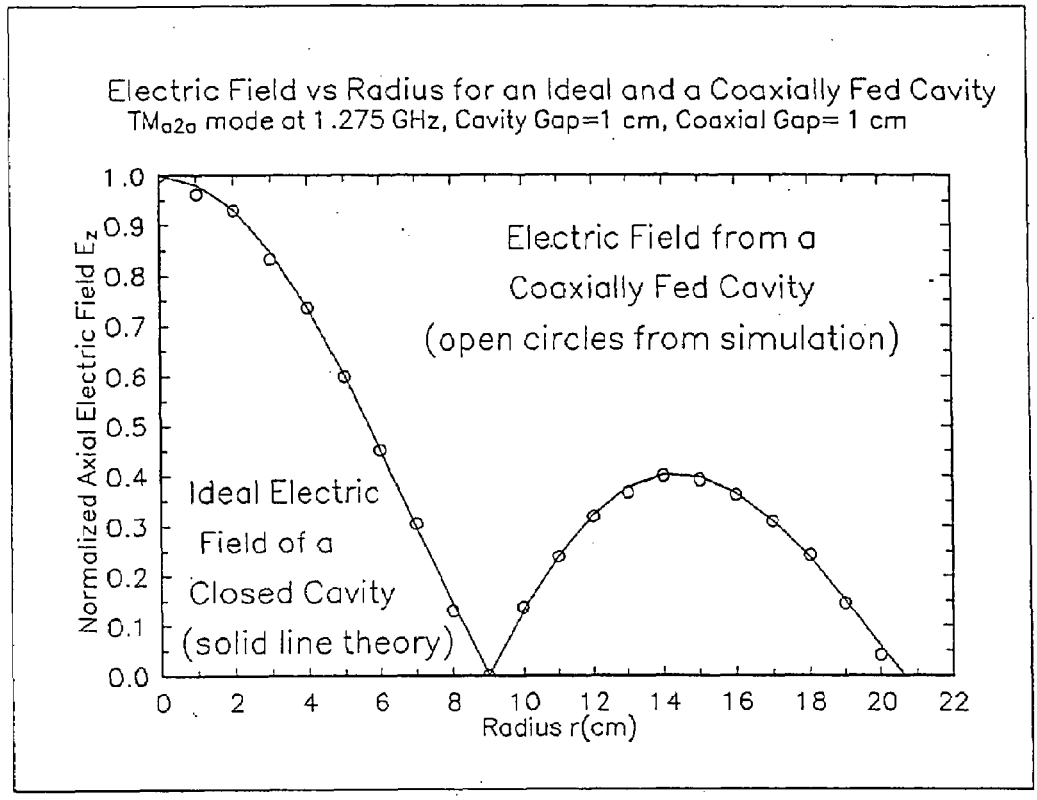
Figure 23: Electric field from a coaxially fed cavity ($TM_{020}$ mode) showing simulation values (open circles) and theoretical curve for an ideal closed cavity.

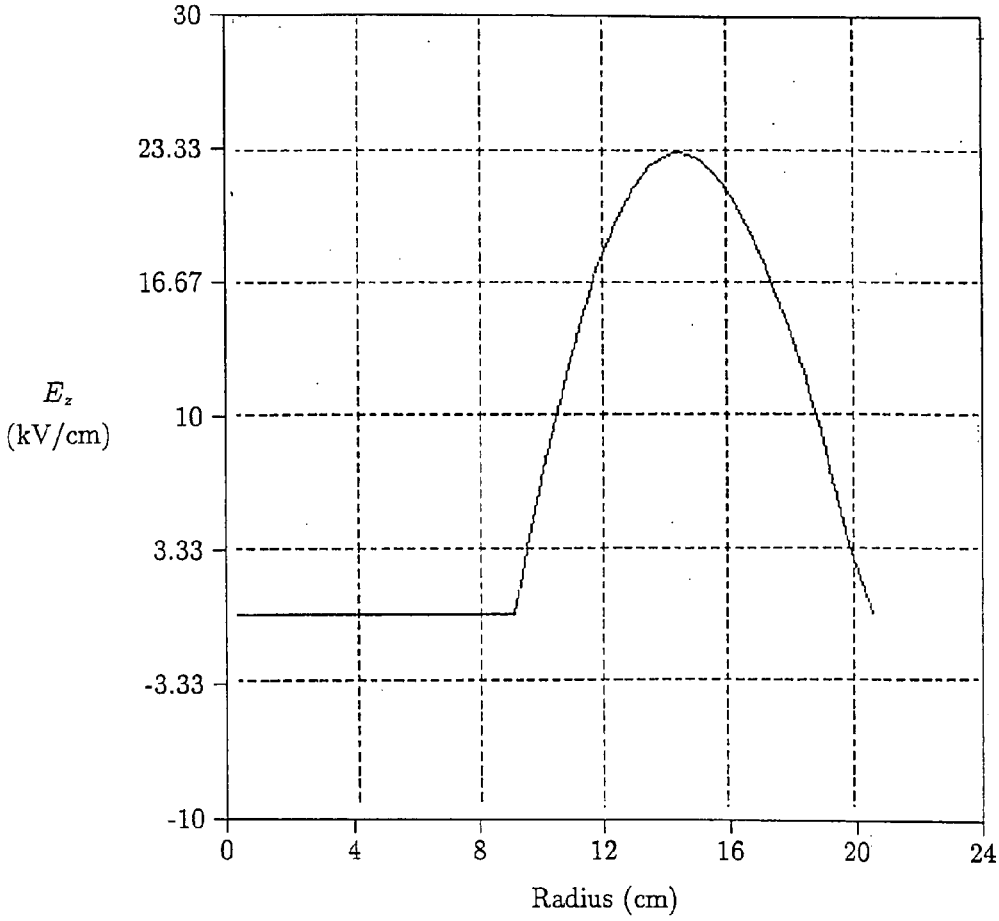
Figure 24: Axial electric field vs. radius from a coaxially fed cavity ($TM_{020}$ mode simulation) with inner conductor at first zero of the mode. The first peak has clearly been eliminated. Frequency 1.275 GHz and one cm gap.

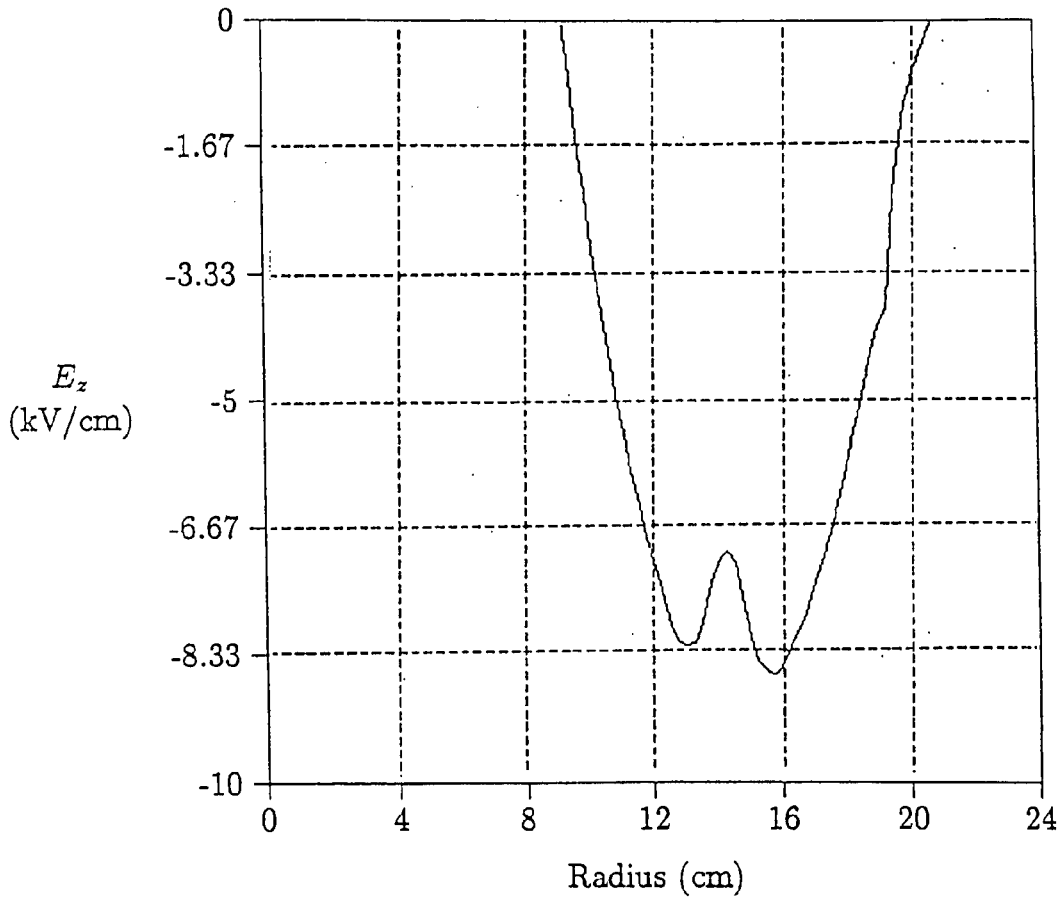
Figure 25: Axial electric field as a function of radius loaded down by a 40 amp/cm$^2$, 25 ps pulse, and one cm diameter electron beam. The curve is inverted compared to the plot of Fig. 24. However, the depression at $R \approx 14$ cm due to space charge is clearly seen.

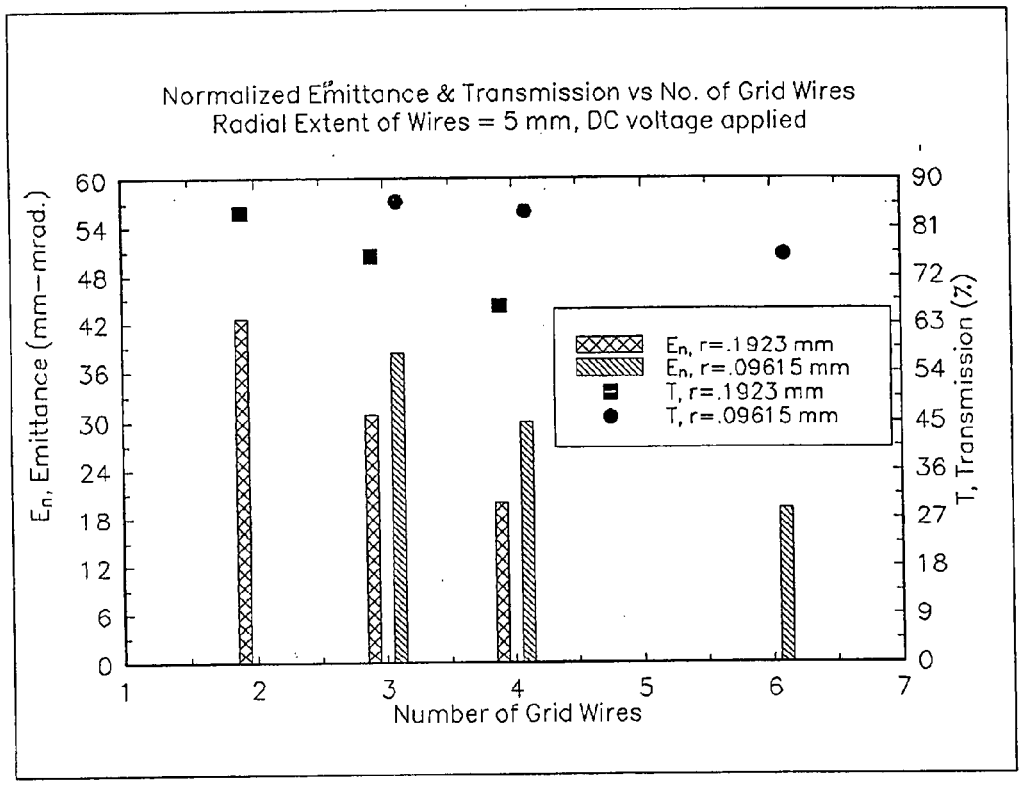
Figure 26: Normalized emmitance and transmission versus number of grid wires with a dc voltage applied to the cavity.

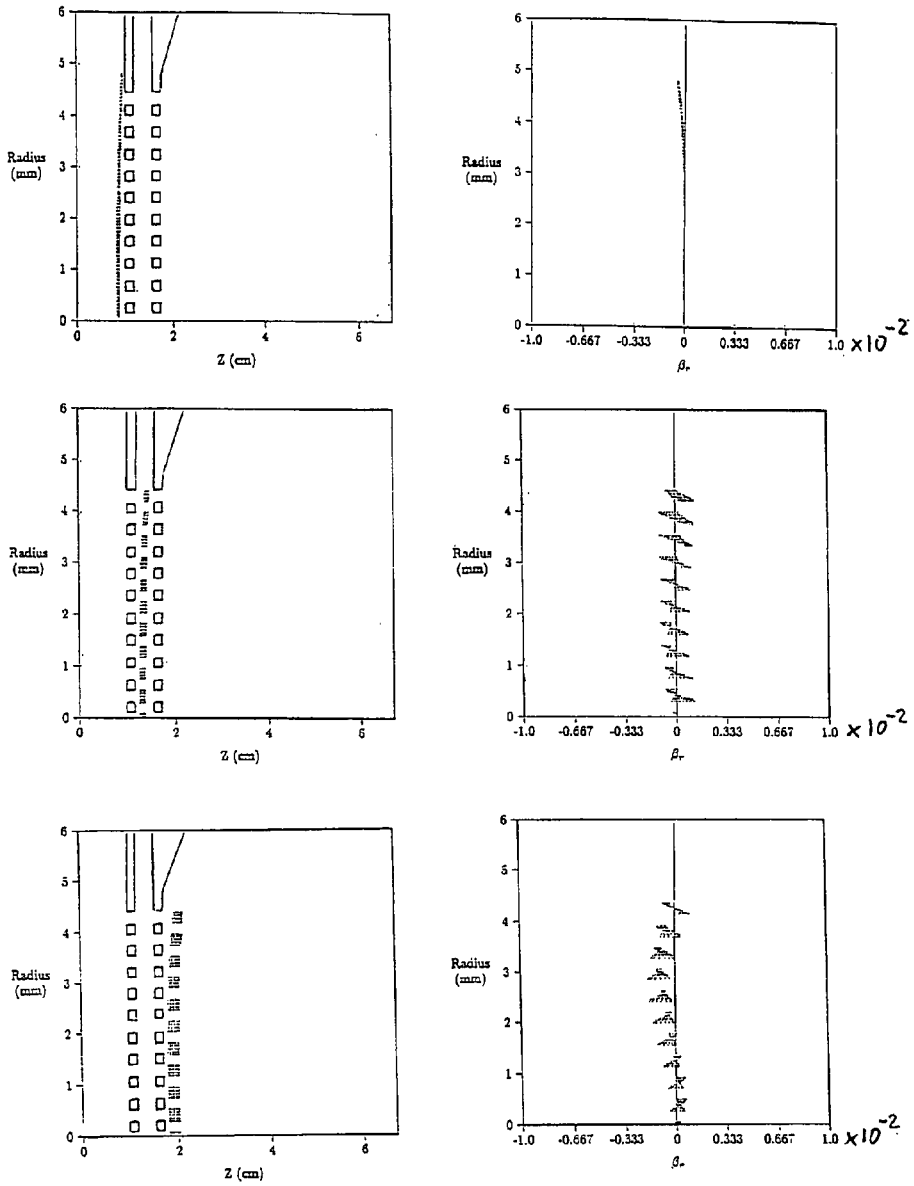
Figure 27: Configuration space and phase space for a solid beam from the simulations. This shows the emittance growth up to the first grid, from the first grid, and from the second grid.

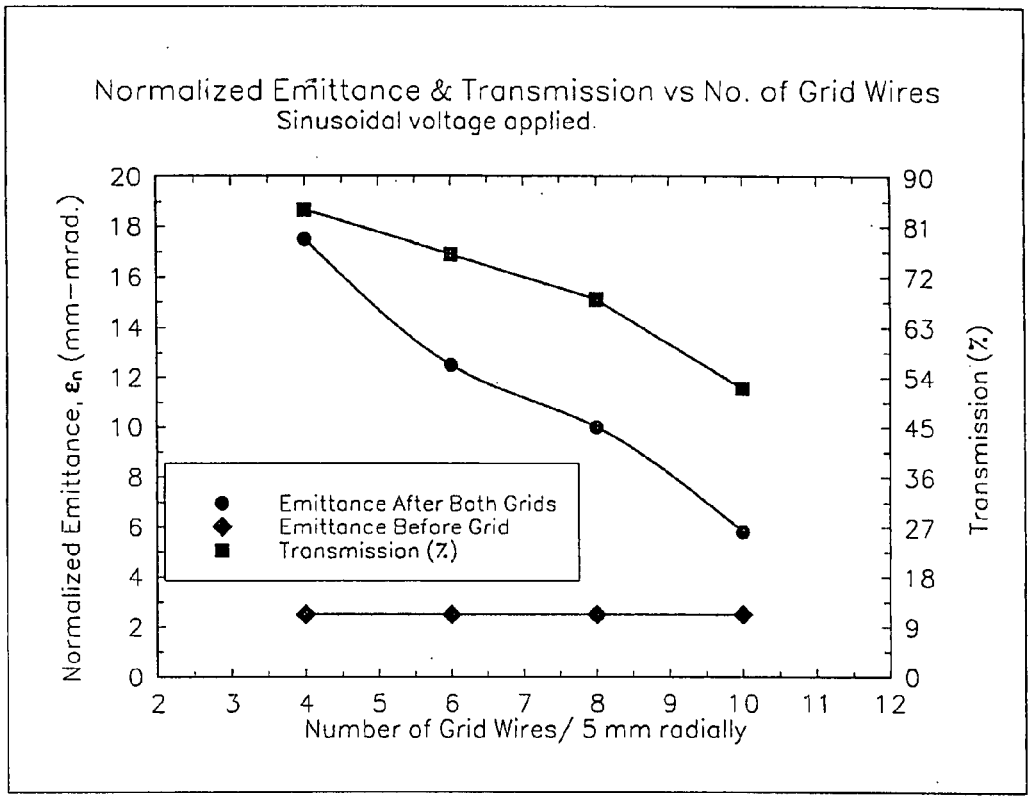
Figure 28: Normalized emmitance and transmission versus number of grid wires with an *ac voltage* applied to the cavity. Grid wire radius is 0.09615 mm.

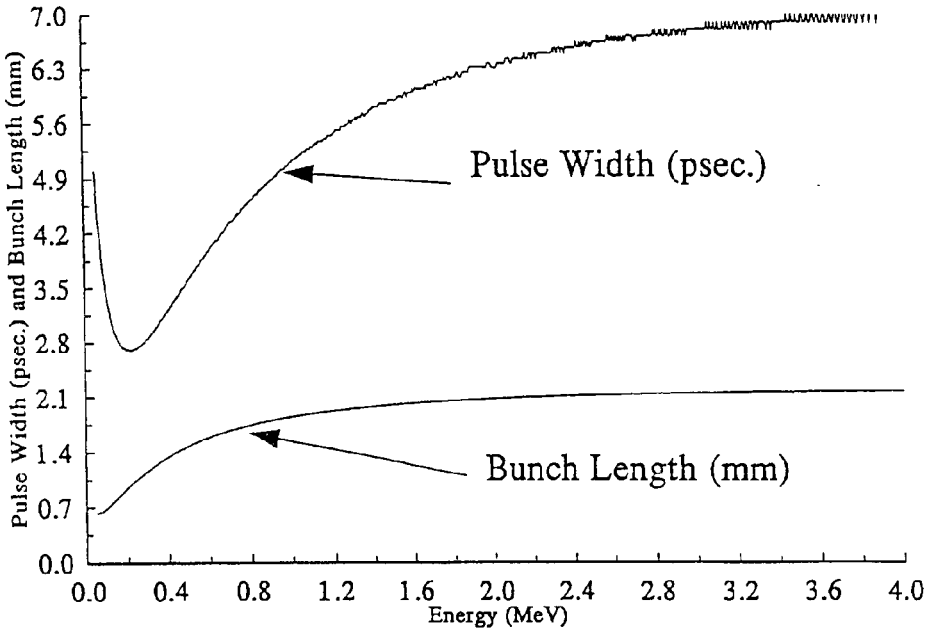
Figure 29: Expansion of micro-pulse from space charge during acceleration, neglecting energy spread. The acceleration field is 20 MV/m and the axial space charge electric field is 2.9 MV/m (corresponding to about 100 nC/cm$^3$). The initial pulse width is 5 ps at an initial energy of 50 keV.

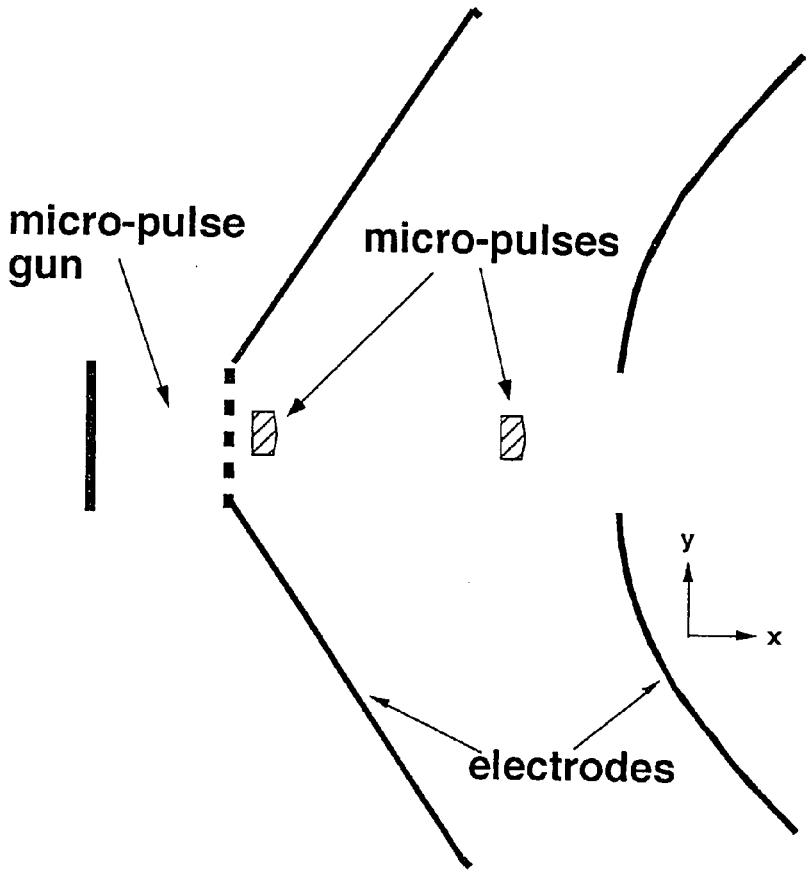
Figure 30: Schematic drawing of a set of electrode shapes for a high-power diode using the modified formulas to the usual Pierce shapes as discussed in the text.

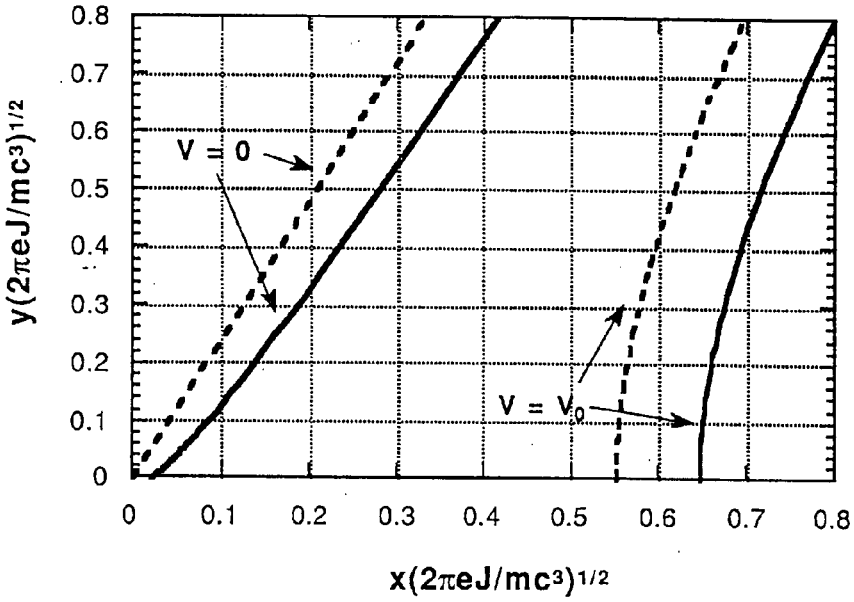
Figure 31: Plot of electrode shapes for a non-space-charge-limited 0.5 MeV diode. The modified shapes [solid lines] and the classical Pierce shapes [broken lines] are shown for comparison. The value of the electric field $E_0$ at the cathode is such that the quantity $\nu = 2$

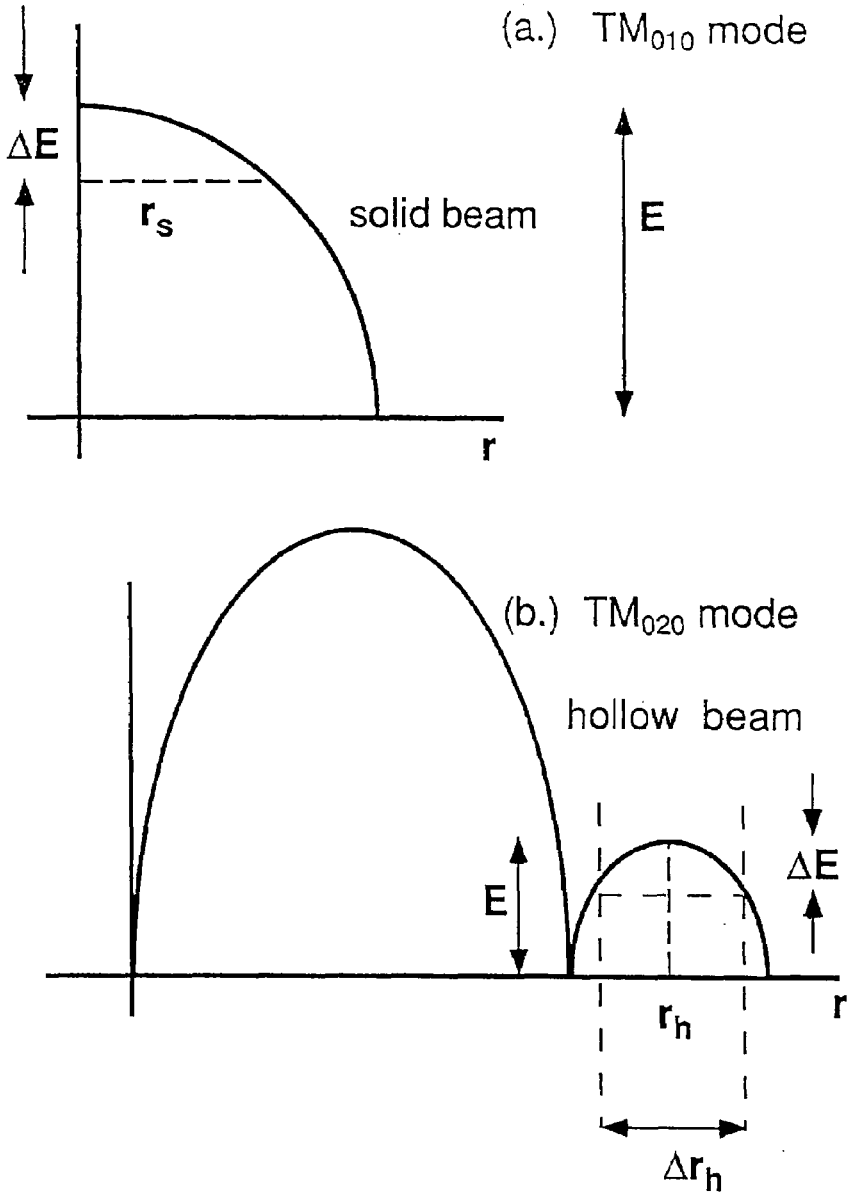
Figure 32: Schematic drawing of emission area and energy spread for a micropulse.

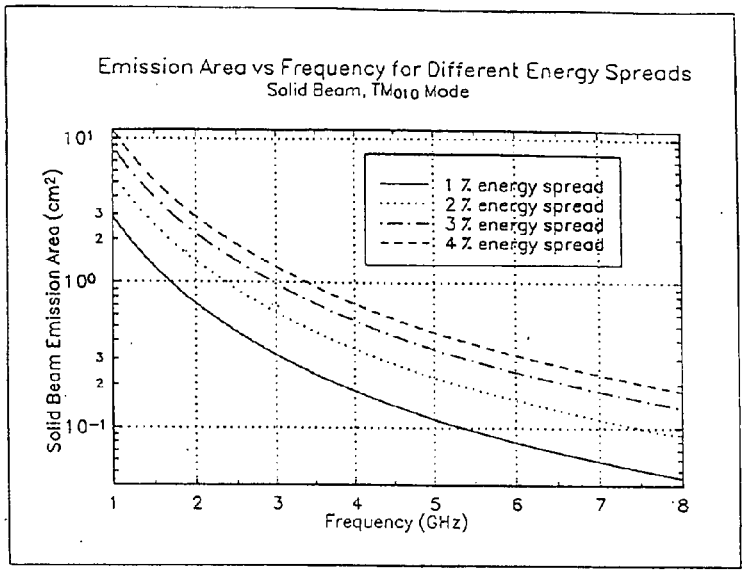
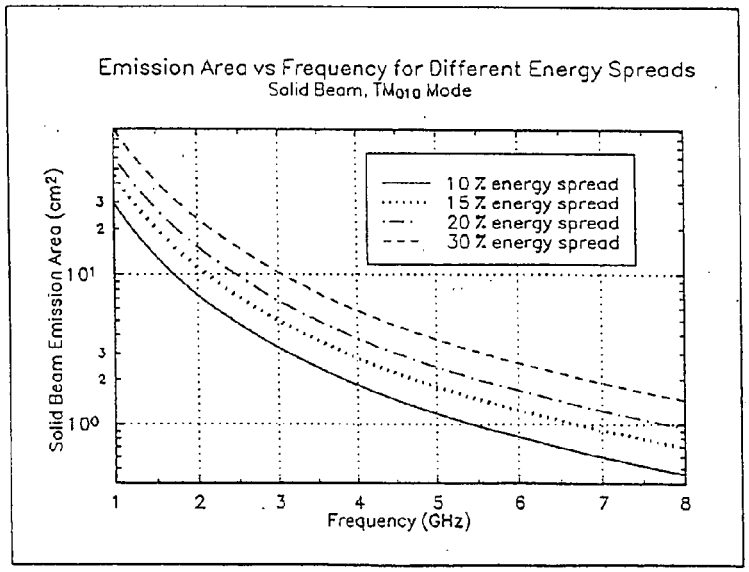
Figure 33: Emission area for a solid beam vs. frequency for different energy spreads (top) 1%-4% energy spread; (bottom) 10%-30% energy spread.

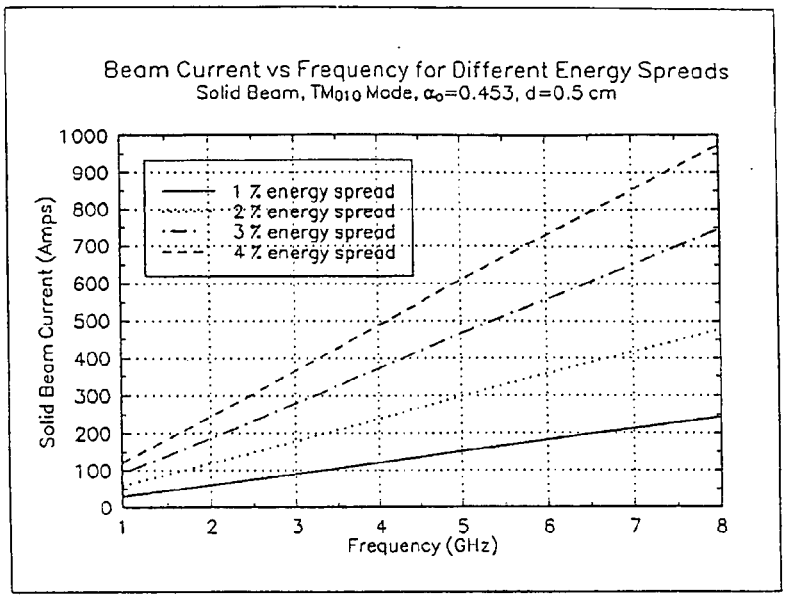
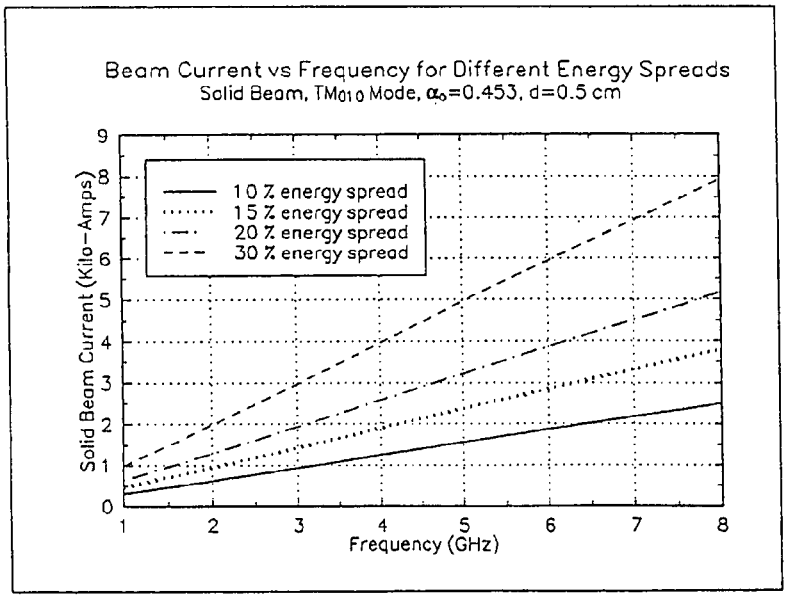
Figure 34: Beam current (solid beam) vs. frequency for different energy spreads and a gap of 0.5 cm.

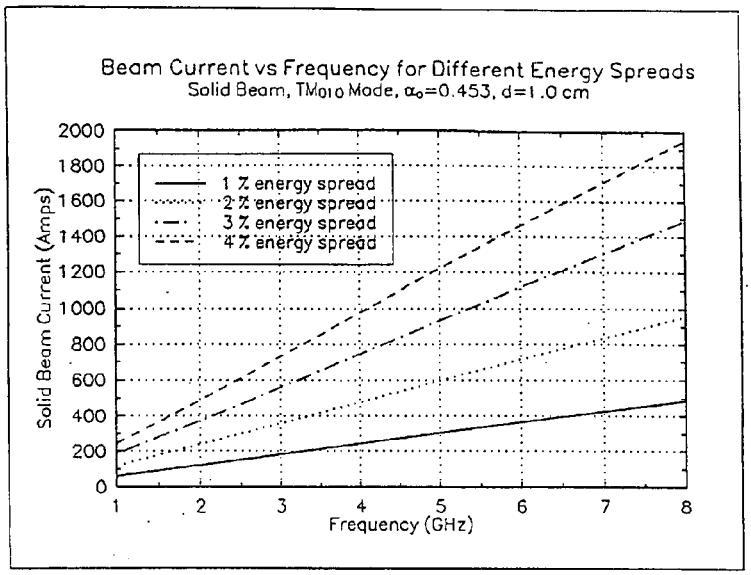
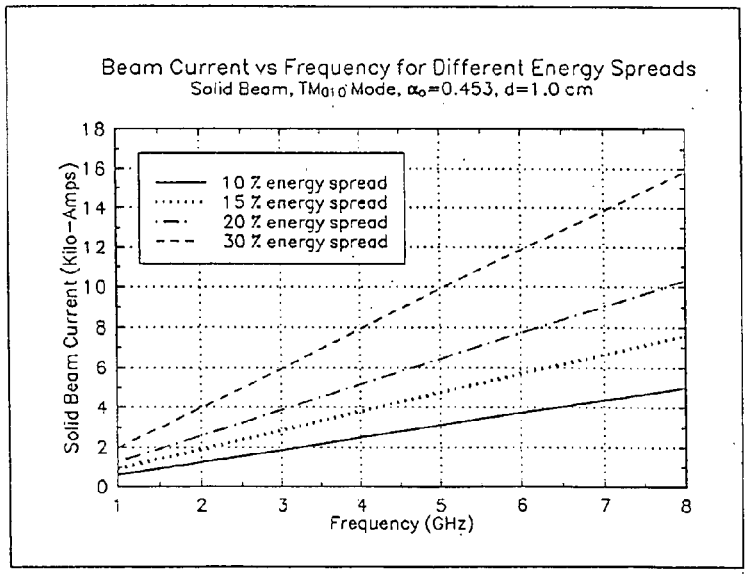
Figure 35: Beam current (solid beam) vs. frequency for different energy spreads and a gap of 1.0 cm.

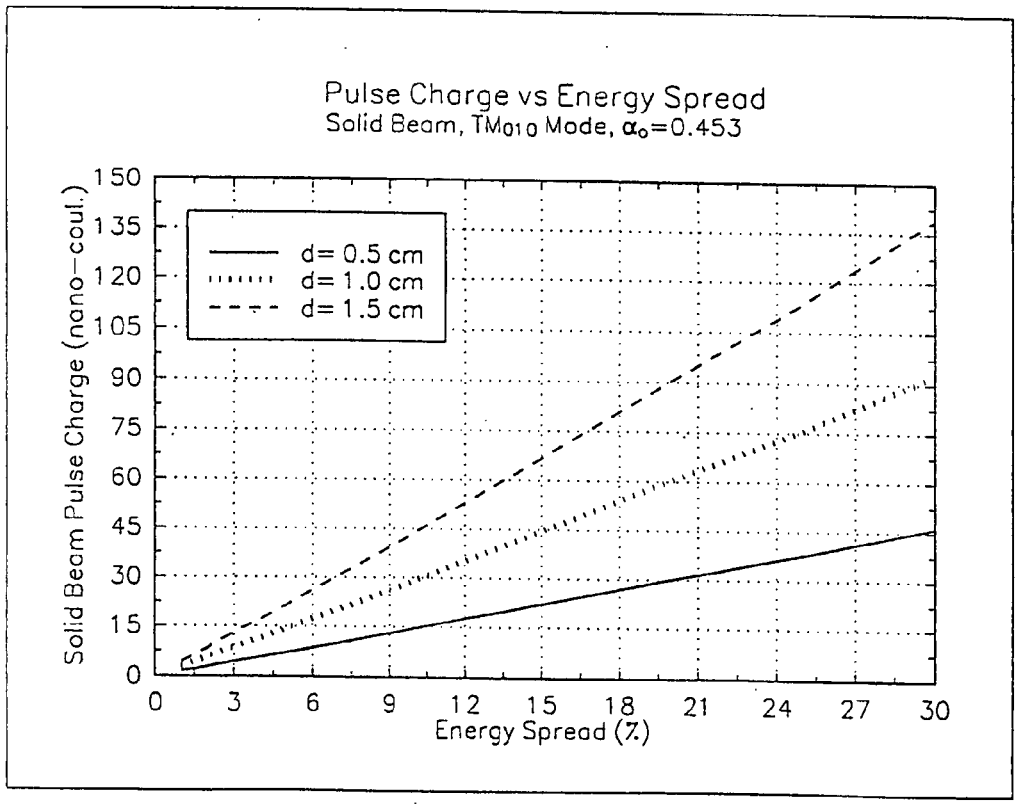
Figure 36: Charge per pulse for a solid beam vs. energy spread.

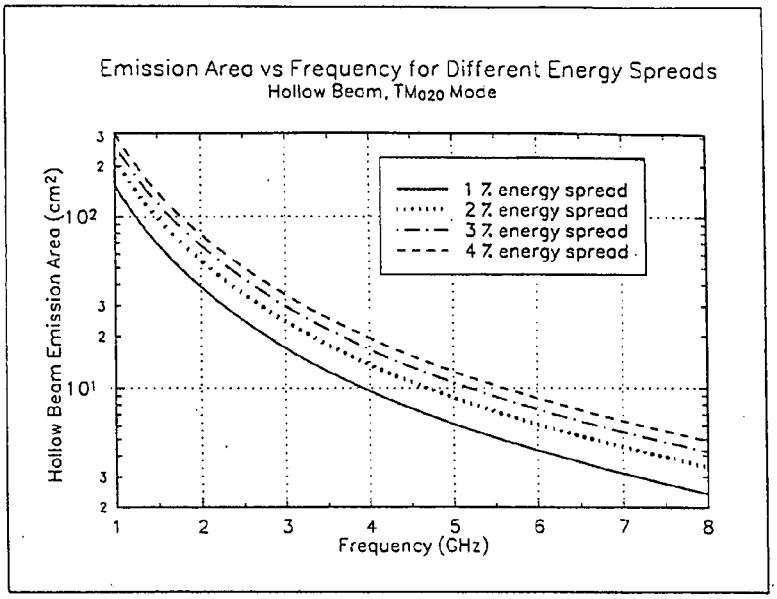
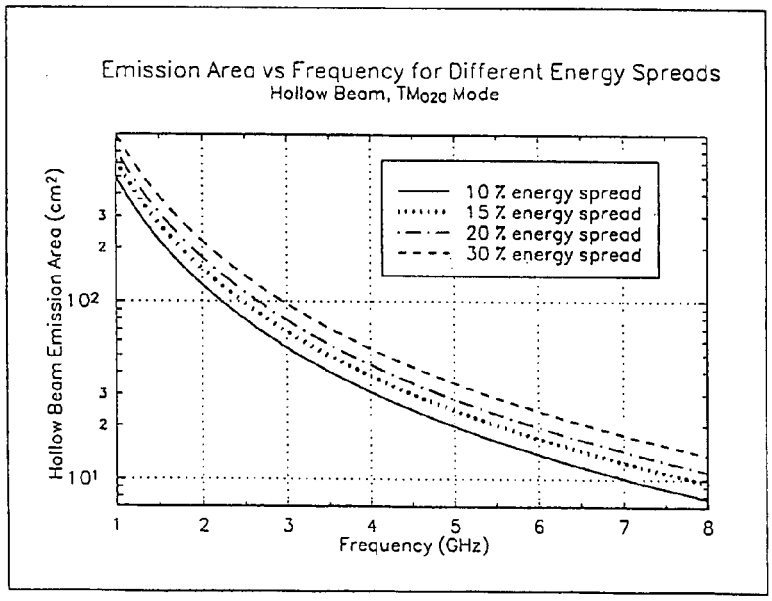
Figure 37: Emission area vs. frequency for different energy spreads. Hollow beam.

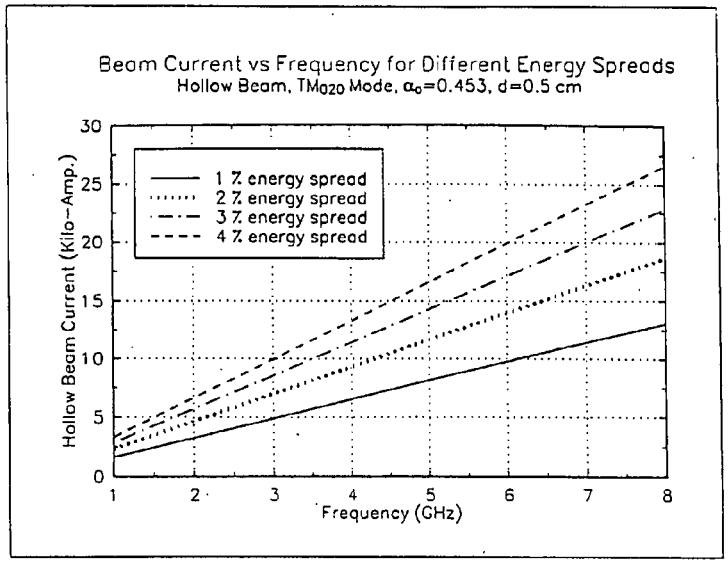
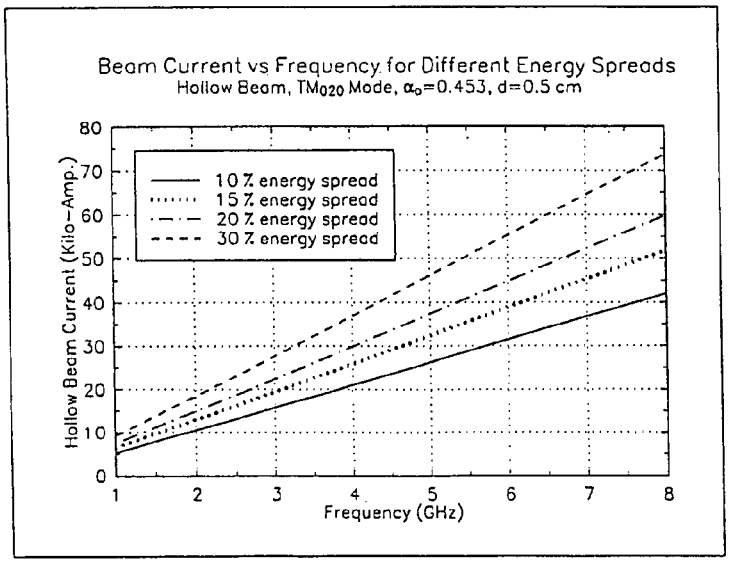
Figure 38: Beam current vs. frequency for different energy spreads. Hollow beam, and $d = 0.5$ cm.

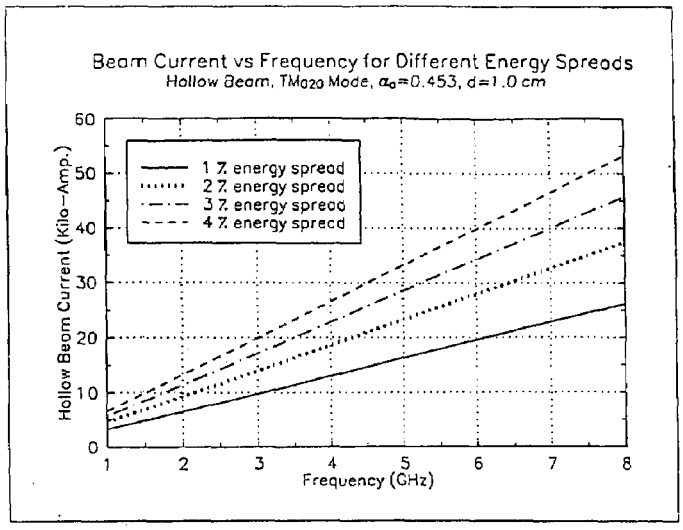
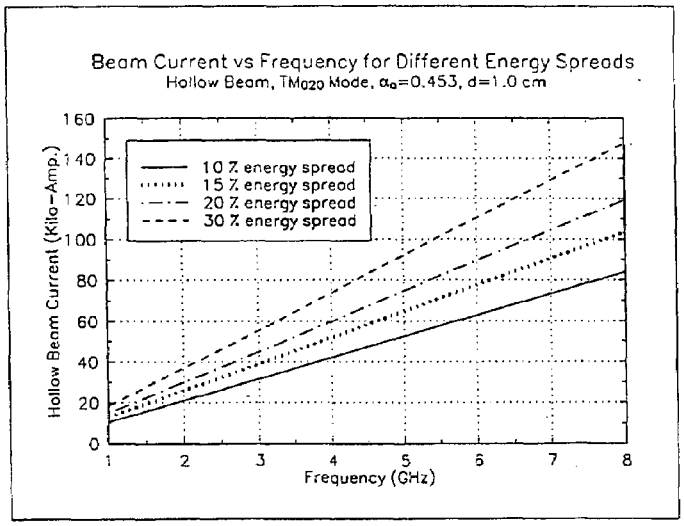
Figure 39: Beam current vs. frequency for different energy spreads. Hollow beam, and $d = 1.0$ cm.

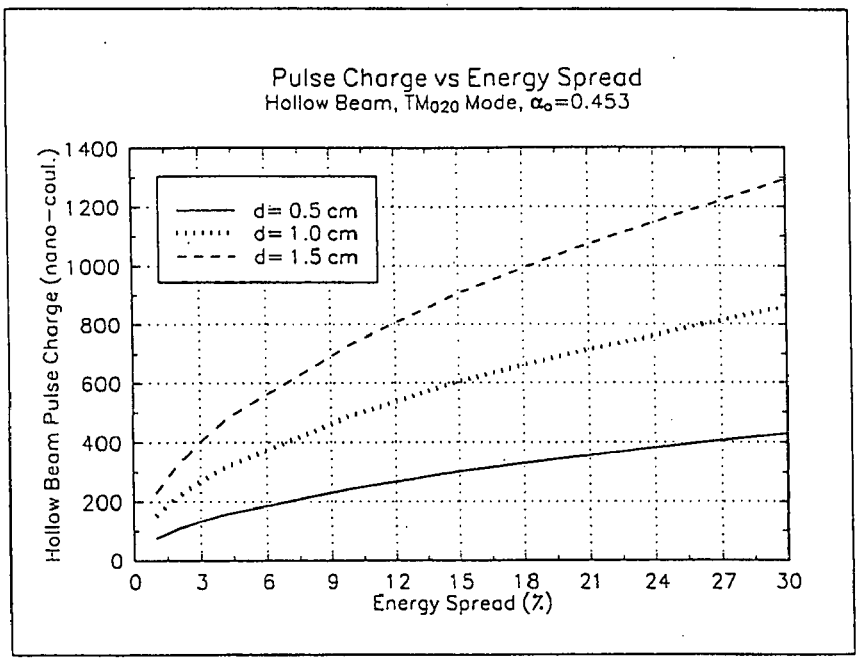
Figure 40: Pulse charge vs. energy spread for hollow beam.

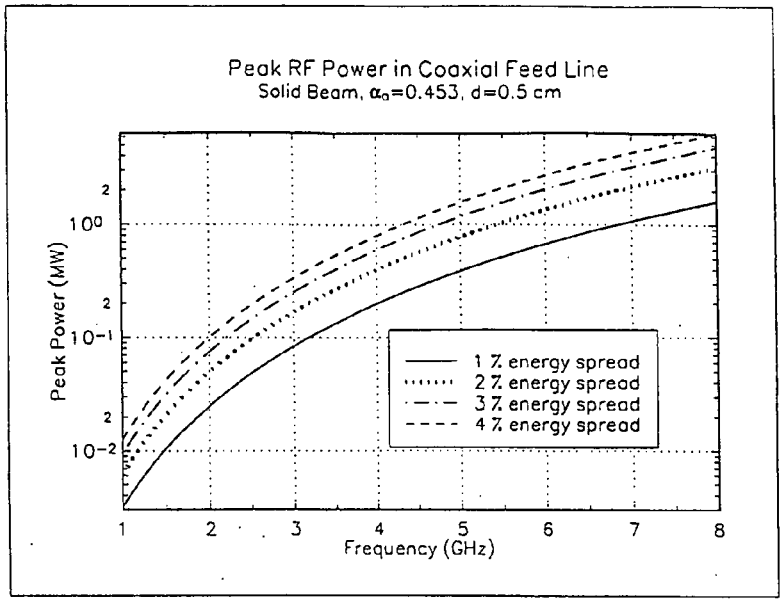
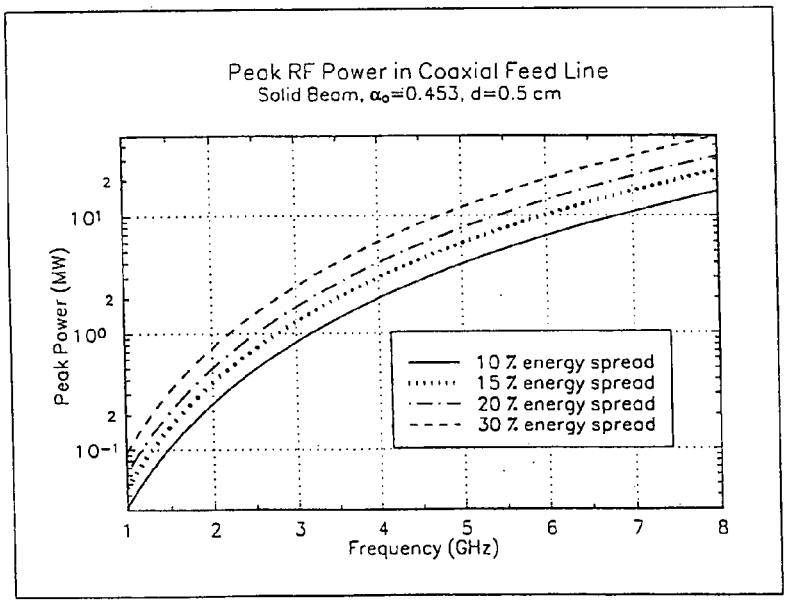
Figure 41: Peak rf power in coaxial feed line for a solid beam, $d = 0.5$ cm.

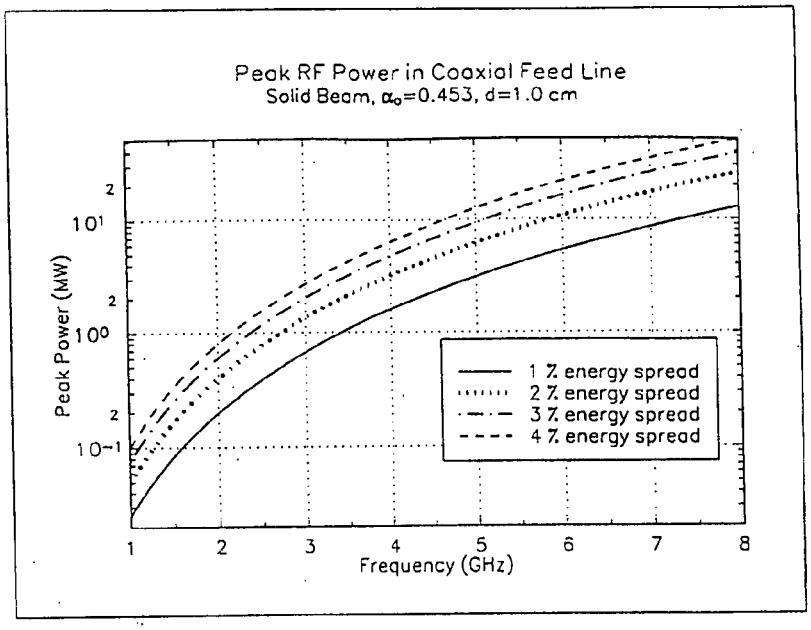
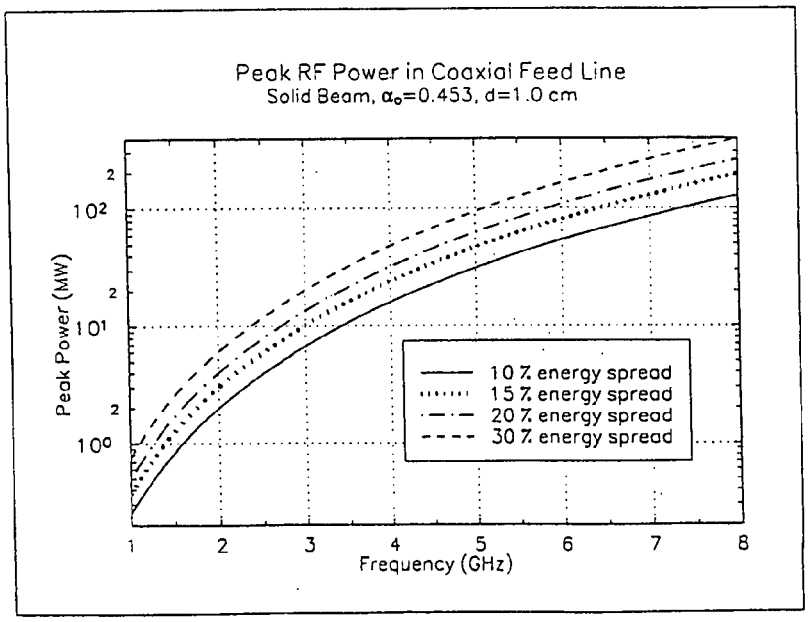
Figure 42: Peak rf power in coaxial feed line for a solid beam, $d = 1.0$ cm.

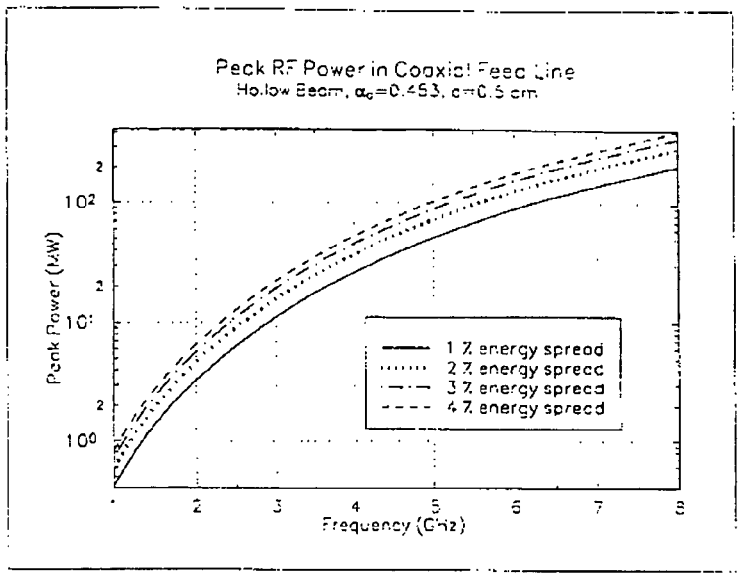
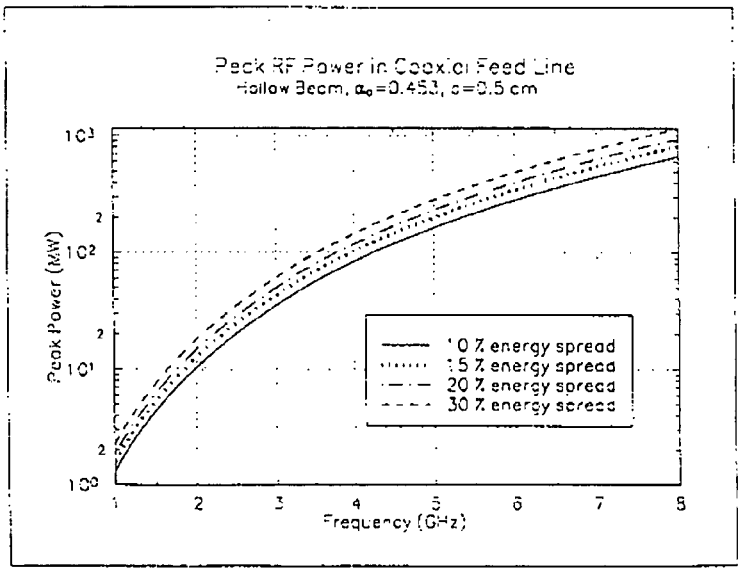
Figure 43: Peak rf power in coaxial feed line for a hollow beam, $d = 0.5$ cm.

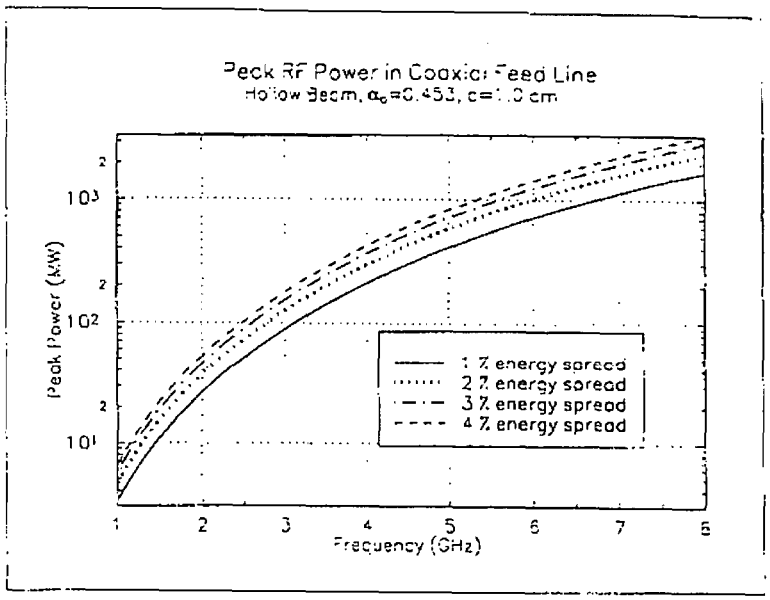
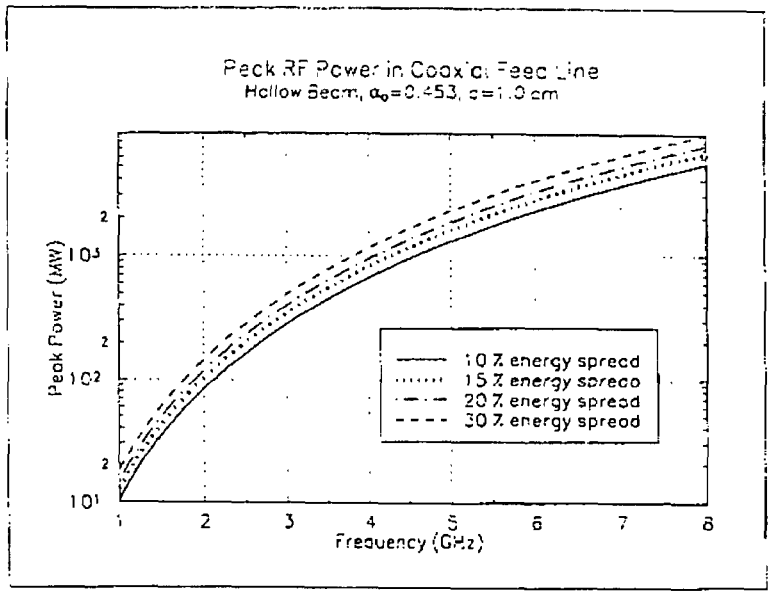
Figure 44: Peak rf power in coaxial feed line for a hollow beam, $d = 1.0$ cm.

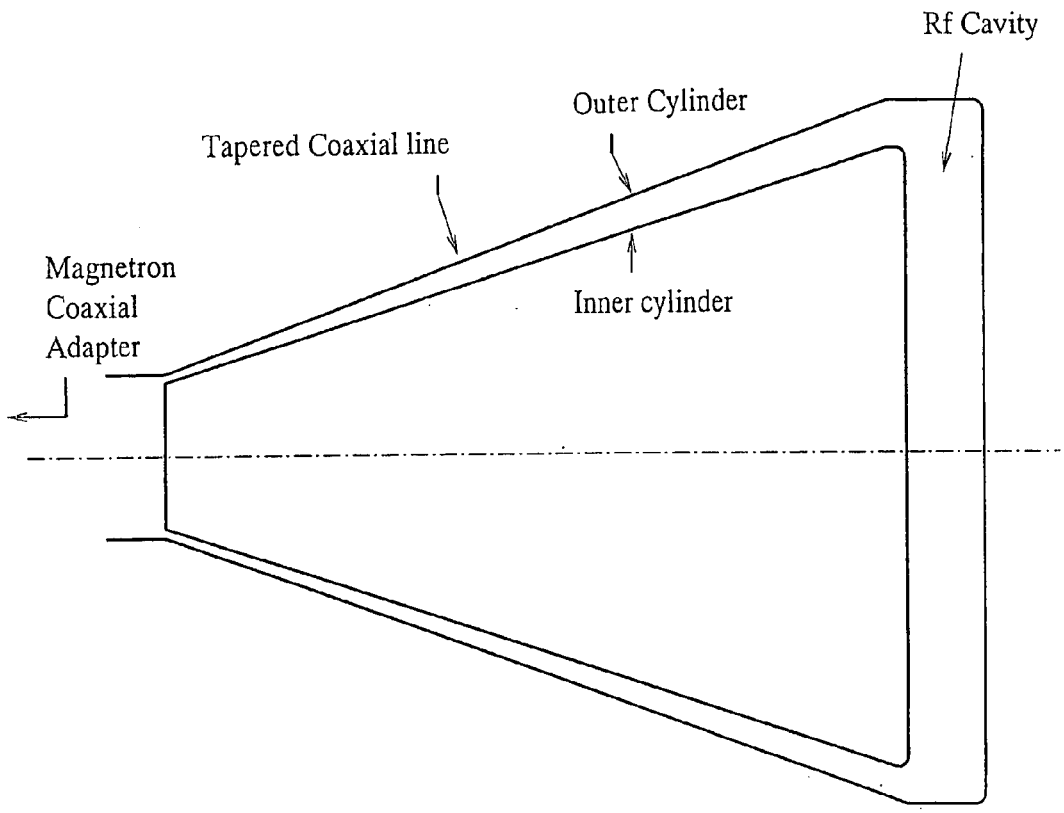
Figure 45: A magnetron feeding energy into the rf cavity. For simplicity a constant, low impedance, coaxial feed line is assumed. Voltage step-up occurs in the rf cavity.

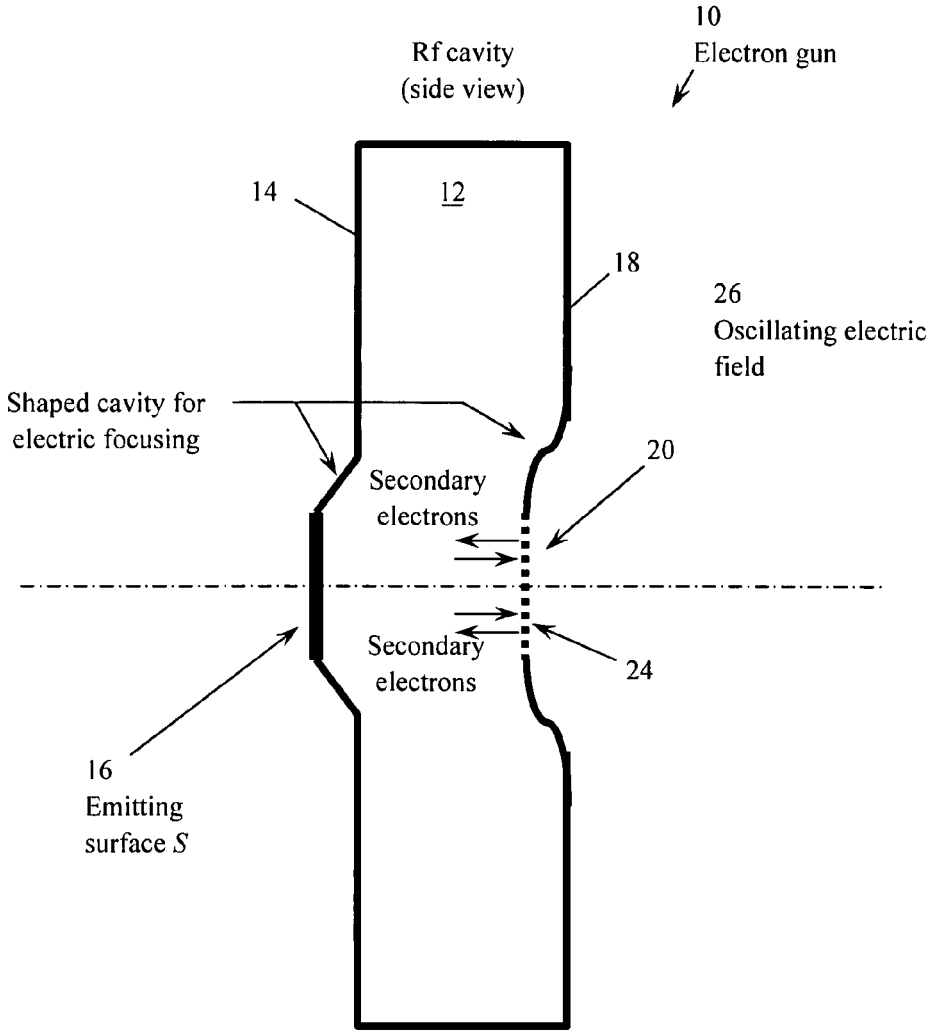
Figure 46: Schematic drawing of a possible design for electrostatic focusing in the MPG.

ELECTRON GUN FOR PRODUCING INCIDENT AND SECONDARY ELECTRONS

This is a continuation application of U.S. patent application Ser. No. 08/348,040 filed Dec. 1, 1994 now abandoned.

FIELD OF THE INVENTION

The present invention is related to electron guns. More specifically, the present invention is related to an electron gun that uses an RF cavity subjected to an oscillating electric field.

BACKGROUND OF THE INVENTION

The development of high-current, short-duration pulses of electrons has been a challenging problem for many years. High-current pulses are widely used in injector systems for electron accelerators, both for industrial linacs as well as high-energy accelerators for linear colliders. Short-duration pulses are also used for microwave generation, in klystrons and related devices, for research on advanced methods of particle acceleration, and for injectors used for free-electron-laser (FEL) drivers.

The difficulty of generating very high-current pulses of short duration can be illustrated by examination of a modern linac injector system. A good example is the system designed and built for the Boeing 120 MeV, 1300 MHz linac, which in turn is used as a FEL driver [J. L. Adamski et al., IEEE Trans. Nucl. Sci. NS-32, 3397 (1985); T. F. Godlove and P. Sprangle, Particle Accelerators 34, 169 (1990)]. The Boeing system uses: (a) a gridded, 100 kV electron gun pulsed with a 3-nanosecond pulse; (b) two low-power prebunchers, the first operating at 108 MHz and the second at 433 MHz; and (c) a high-power, tapered-velocity buncher which accelerates the beam bunches up to 2 MeV. The design relies on extensive calculations with computer codes such as EGUN and PARMELA. A carefully tapered, axial magnetic field is applied which starts from zero at the cathode and rises to about 500 Gauss.

With this relatively complex system Boeing obtains a peak current up to about 400 A in pulses of 15 to 20 ps duration, with good emittance. The bunching process yields a peak current which is two orders of magnitude larger than the electron gun current. Space charge forces, which cause the beam to expand both radially and axially, are minimized by using a strong electric field in the high-power buncher, and finally are balanced by forces due to the axial magnetic field. The performance achieved by Boeing appears to be at or near the limit of this type of injector.

During the last few years considerable effort has also been applied to the development of laser-initiated photocathode injectors [J. S. Fraser and R. L. Sheffield, IEEE J. Quantum Elec. QE-23, 1489 (1987); Proc. 9th Int'l FEL Conf., ed. P. Sprangle, C. M. Tang, and J. Walsh, North Holland Publishing, Amsterdam, (1988). R. L. Sheffield, E. R. Gray and J. S. Fraser, p.222; P. J. Tallerico, J. P. Coulon, LA-11189-MS (1988); P. J. Tallerico et al, Linac Proc. 528 (1989); M. E. Jones and W. Peter, IEEE trans. Nucl. Sci. 32 (5), 1794 (1985); P. Schoessow, E. Chojnacki, W. Gai, C. Ho, R. Konecny, S. Mtingwa, J. Norem, M. Rosing, and J. Simpson, Proc. of the 2nd European Particle Accel.Conf. (1990), p. 606]. The best of these have somewhat higher brightness than the Boeing injector, but the reliability depends on the choice of photocathode material, with the more reliable materials requiring a larger laser illumination.

SUMMARY OF THE INVENTION

Micro-pulses or bunches are produced by resonantly amplifying a current of secondary electrons in an rf cavity. Bunching occurs rapidly and is followed by saturation of the current density within ten rf periods. The "bunching" process is not the conventional method of compressing a long beam into a short one, but results by selecting particles that are in phase with the rf electric field, i.e., resonant. One wall of the cavity is highly transparent to electrons but opaque to the input rf field. The transparent wall allows for the transmission of the energetic electron bunches and serves as the cathode of a high-voltage injector. FIG. 1 shows a perspective view of the micropulse gun emitting electron-bunches in an annular geometry. Axial and radial expansion of the pulse is minimized outside the cavity by using rapid acceleration and a combination of electrostatic and magnetic focusing. Inside the cavity, radial expansion is controlled by electric and/or magnetic fields. Both analytic theory and PIC simulation verify this concept. This micro-pulse electron gun should provide a high peak power, multi-kiloampere, picosecond-long electron source which is suitable for many applications. Of particular interest are: high energy picosecond electron injectors for linear colliders, free electron lasers and high harmonic rf generators for linear colliders, or super-power nanosecond radar.

The present invention pertains to an electron gun. The electron gun comprises an RF cavity having a first side with an emitting surface and a second side with a transmitting and emitting section. The gun is also comprised of a mechanism for producing an oscillating force which encompasses the emitting surface and the section so electrons are directed between the emitting surface and the section to contact the emitting surface and generate additional electrons and to contact the section to generate additional electrons or escape the cavity through the section.

The section preferably isolates the cavity from external forces outside and adjacent the cavity. The section preferably includes a transmitting and emitting screen. The screen can be of an annular shape, or of a circular shape, or of a rhombohedron shape.

The mechanism preferably includes a mechanism for producing an oscillating electric field that provides the force and which has a radial component that prevents the electrons from straying out of the region between the screen and the emitting surface. Additionally, the gun includes a mechanism for producing a magnetic field to force the electrons between the screen and the emitting surface.

The present invention pertains to a method for producing electrons. The method comprises the steps of moving at least a first electron in a first direction. Next there is the step of striking a first area with the first electron. Then there is the step of producing additional electrons at the first area due to the first electron. Next there is the step of moving electrons from the first area to a second area and transmitting electrons through the second area and creating more electrons due to electrons from the first area striking the second area. These newly created electrons from the second area then strike the first area, creating even more electrons in a recursive, repeating manner between the first and second areas.

BRIEF DESCRIPTION OF THE DRAWINGS

In the accompanying drawings, the preferred embodiment of the invention and preferred methods of practicing the invention are illustrated in which:

FIG. 1 is a perspective view of the micropulse gun for a hollow beam in the $TM_{020}$ mode. The inner conductor is not shown.

FIG. 2 is a schematic of rf gun operating in $TM_{020}$ mode.

FIG. 3 is a schematic of micropulse gun for solid beam ($TM_{010}$) mode. A coaxial feed is used for rf input (not shown).

FIG. 4 is a secondary electron emission yield curve for GaP and MgO.

FIG. 5 is a schematic drawing of model used in theoretical analysis.

FIG. 6 is a steady-state current density and bunch length vs. rf field, all parameters are normalized.

FIG. 7 is a plot of resonant electric fields for $\alpha_0$=0.453 and various gap spacings. Also shown is the critical Kilpatrick electric field as a function of rf frequency.

FIG. 8 is a series of time "snapshots" for a 1.3 GHz, d=0.5 cm cavity using the two-dimensional PIC code with secondary emission. Note the rapid particle build-up and bunching by phase selection. Electrons traverse the horizontal axis. On the vertical axis emission is limited to the region 0.25 to 0.32 cm.

FIG. 9 is a plot of current density vs. time for simulation with rf frequency 1.3 GHz, voltage amplitude 4.3 kV, d=0.5 cm, and $\alpha_0$=0.453.

FIG. 10 is a plot of current density vs. time for simulation with rf frequency 6.4 GHz, voltage amplitude 105 kV, d=0.5 cm, and $\alpha_0$=0.453.

FIG. 11 is a current density in kA/cm$^2$ for an off-resonance d=0.5 cm cavity with frequency 1.3 GHz and higher voltage 9.8 kV. Note that not only does current amplification not occur, but the steady-state current is zero.

FIG. 12 is a steady-state current density vs. rf frequency for cavity with $\alpha_0$=0.453 and gap lengths of (a) 0.5 cm (solid line) and (b) 1.0 cm (dashed line)

FIG. 13 is a micro-pulse duration vs. frequency for $\alpha_0$=0.453.

FIG. 14 is a micro-pulse width (as a fraction of the half-cycle) vs. rf cycle number near the output grid. The full beam pulse width decreases with time, and reaches a minimum at the fourth rf cycle. After saturation there is a slight increase in pulse-width due to space-charge effects.

FIG. 15 is a longitudinal electric field in kv/cm as measured by a probe near the exit grid for the 6.4 GHz, 105 kV simulation.

FIG. 16 is a plot of the current density in kA/cm$^2$ [solid line] and the longitudinal electric field [dashed line] for the 6.4 GHz, 105 kV simulation.

FIG. 17 is a resonant Tuning Curve (both simulation and theory) showing the tolerance of the micropulse electron gun.

FIG. 18 is a comparison of peak current density in KA/cm$^2$ versus frequency for simulation and theory for a gap length of 0.5 cm and drive parameter $\alpha_0$=0.453.

FIG. 19 is a side view of a cylindrical symmetric coaxial transmission line and cavity. An rf wave is launched at the left end of the coaxial line.

FIG. 20 is resulting voltages for a $TM_{010}$ cavity at 1.275 GHz (9 cm radius) with a one cm cavity gap and one cm coaxial gap. (top) voltage measured at entrance of coax, and (bottom) voltage measured at cavity center.

FIG. 21 is an electric field from a coaxially fed cavity ($TM_{010}$ mode) showing simulation values (open circles) and theoretical curve for an ideal closed cavity.

FIG. 22 is an axial electric field in cavity with a one cm diameter, 40 amp/cm$^2$, 25 ps long beam emitted into the cavity. The curve is inverted compared to the plot of FIG. 21. However, the depression at R=0 cm due to space charge is clearly seen. Beam loading reduces the field by about ⅓.

FIG. 23 is an electric field from a coaxially fed cavity ($TM_{020}$ mode) showing simulation values (open circles) and theoretical curve for an ideal closed cavity.

FIG. 24 is an axial electric field vs. radius from a coaxially fed cavity ($TM_{020}$ mode (simulation) with inner conductor at first zero of the mode. The first peak has clearly been eliminated. Frequency 1.275 GHz and one cm gap.

FIG. 25 is an axial electric field as a function of radius loaded down by a 40 amp/cm$^2$, 25 ps pulse, and one cm diameter electron beam. The curve is inverted compared to the plot of FIG. 24. However, the depression at R≈14 cm due to space charge is clearly seen.

FIG. 26 is a normalized emmitance and transmission versus number of grid wires with a dc voltage applied to the cavity.

FIG. 27 is a configuration space and phase space for a solid beam from the simulations. This shows the emittance growth up to the first grid, from the first grid, and from the second grid.

FIG. 28 is a normalized emmitance and transmission versus number of grid wires with an ac voltage applied to the cavity. Grid wire radius is 0.09615 mm.

FIG. 29 is an expansion of micro-pulse from space charge during acceleration, neglecting energy spread. The acceleration field is 20 MV/m and the axial space charge electric field is 2.9 MV/m (corresponding to about 100 nC/cm$^3$). The initial pulse width is 5 ps at an initial energy of 50 kev.

FIG. 30 is a schematic drawing of a set of electrode shapes for a high-power diode using the modified formulas to the usual Pierce shapes as discussed below.

FIG. 31 is a plot of electrode shapes for a non-space-charge-limited 0.5 MeV diode. The modified shapes [solid lines] and the classical Pierce shapes [broken lines] are shown for comparison. The value of the electric field $E_0$ at the cathode is such that the quantity $\nu$=2.

FIG. 32 is a schematic drawing of emission area and energy spread for a micropulse.

FIG. 33 is an emission area for a solid beam vs. frequency for different energy spreads (top) 1%-4% energy spread; (bottom) 10%-30% energy spread.

FIG. 34 is a beam current (solid beam) vs. frequency for different energy spreads and a gap of 0.5 cm.

FIG. 35 is a beam current (solid beam) vs. frequency for different energy spreads and a gap of 1.0 cm.

FIG. 36 is a charge per pulse f or a solid beam vs. energy spread.

FIG. 37 is an emission area vs. frequency for different energy spreads. Hollow beam.

FIG. 38 is a beam current vs. frequency for different energy spreads. Hollow beam, and d=0.5 cm.

FIG. 39 is a beam current vs. frequency for different energy spreads. Hollow beam, and d=1.0 cm.

FIG. 40 is a pulse charge vs. energy for hollow beam.

FIG. 41 is a peak rf power in coaxial feed line for a solid beam, d=0.5 cm.

FIG. 42 is a peak rf power in coaxial feed line for a solid beam, d=1.0 cm.

FIG. 43 is a peak rf power in coaxial feed line for a solid beam, d=0.5 cm.

FIG. 44 is a peak rf power in coaxial feed line for a solid beam, d=1.0 cm.

FIG. 45 is a magnetron feeding energy into the rf cavity. For simplicity a constant, low impedance, coaxial feed line is assumed. Voltage step-up occurs in the rf cavity.

FIG. 46 is a schematic drawing of a possible design for electrostatic focusing in the MPG.

DESCRIPTION OF THE PREFERRED EMBODIMENT

Referring now to the drawings wherein like reference numerals refer to similar or identical parts throughout the several views, and more specifically to FIG. 1 thereof, there is shown an electron gun 10. The electron gun 10 comprises an RF cavity 12 having a first side 14 with an emitting surface 16 and a second side 18 with a transmitting and emitting section 20. The gun 10 is also comprised of a mechanism 22 for producing an oscillating force which encompasses the emitting surface 16 and the section 20 so electrons 11 are directed between the emitting surface 16 and the section 20 to contact the emitting surface 16 and generate additional electrons 11 and to contact the section 20 to generate additional electrons 11 or escape the cavity 12 through the section 20 giving the transmitted electrons 21.

The section 20 preferably isolates the cavity 12 from external forces outside and adjacent the cavity 12. The section 20 preferably includes a transmitting and emitting screen 24. The screen 24 can be of an annular shape, or of a circular shape, or of a rhombohedron shape.

The mechanism 22 preferably includes a mechanism 26 for producing an oscillating electric field that provides the force and which has a radial component that prevents the electrons 11 from straying out of the region between the screen 24 and the emitting surface 16. Additionally, the gun 10 includes a mechanism 28 for producing a magnetic field to force the electrons 11 between the screen 24 and the emitting surface 16.

The present invention pertains to a method for producing electrons 11. The method comprises the steps of moving at least a first electron 11 in a first direction. Next there is the step of striking a first area with the first electron 11. Then there is the step of producing additional electrons 11 at the first area due to the first electron 11. Next there is the step of moving electrons from the first area to a second area and transmitting electrons 21 through the second area and creating more electrons 11 due to electrons from the first area striking the second area. This process is repeated until the device is shut off by removing the rf power source.

A schematic of one embodiment of the proposed device is given in FIG. 2. Although the design shown is not necessarily optimum it provides a basis for describing the invention. Shown in FIG. 2 is a side view of a cylindrically symmetric device. The rf power is fed into the cavity by a low impedance coaxial transmission line connected to the perimeter of the cavity. Alternatively, rf power may be fed into the cavity by the conventional method of side coupling using a tapered waveguide. The appropriate mode is then set up (in this case the $TM_{020}$ mode). An annular electron pulse is generated by secondary emission at the second peak of the electric field in the cavity operating in a $TM_{020}$ mode. The first peak is eliminated by placing an inner conducting cylinder at the first zero of the $TM_{020}$ mode. The pulse rapidly bunches and reaches a saturated state within several rf periods. This rapid bunching and saturation is due to a combination of the space charge field and the resonant rf field condition. The right wall of the cavity in FIG. 2 (also see detail) is constructed with a transmitting annular shaped double screen (grid) which allows for the transmission of a high current density hollow electron pulse. The radial wires maintain a path for the rf current. The double screen provides a means to isolate the accelerating and rf fields thus preventing the accelerating field from pulling out electrons that are not resonant with the rf field. Also, the second grid (to the right) is electrically isolated from the first grid and can be dc biased (≈−100 volts) to create a barrier for low energy electrons. The emittance in the micro-pulse gun (MPG) is lower than would be expected for a dc gun. The main point is that the resonant particles are loaded into the wave at low phase angles and when they reach the opposite electrode or grid, they experience a reduced transverse kick from the grid wires. Inside the cavity, radial expansion is controlled by an axial magnetic field. The short-pulse, high-current electron pulse leaves the cavity with high kinetic energy. The pulse is then accelerated to much higher energy by either electrostatic, inductive or rf means. The application for the above hollow beam configuration is primarily suited to high harmonic microwave production. An alternative configuration which produces a solid beam is the $TM_{010}$ mode. This configuration will be more suitable for injector applications.

In FIG. 3 is shown an rf cavity operating in a $TM_{010}$ mode. Now assume at one of the electrode walls (the screen or grid) of the cavity there is a single electron at rest near the axis. This electron is accelerated across the cavity and strikes the surface S. A number $\delta_1$ of secondary electrons are emitted off this electrode. Provided the average transit time of an electron in the cavity is one-half the rf period, and that the secondary electrons are in the proper phase with the rf field, these electrons will be accelerated towards the screen. If $\delta_1$ is the secondary electron yield per primary electron, then upon reaching the screen, $\delta_1 T$ electrons will be transmitted where T is the transmission factor of the screen. The number of electrons which are not transmitted is then $\delta_1(1-T)$. This is the number of electrons which are stopped by the screen, and can thus produce $\delta_1\delta_2(1-T)$ secondary electrons. $\delta_2$ is the secondary electron yield from the screen. In order to have a gain of electrons, the number of secondaries produced must be greater than unity, that is, $$\delta_1\delta_2(1-T)>1 \tag{1}$$

The gain of electrons at time t after a number of transits can be derived and is shown to be $$G=[\delta_6\delta_2(1-T)]^{(\omega t/2\pi)}$$

where $\pi/\omega$ is the half-period of the radian rf frequency $\omega$. If there is a "seed" current density JS in the cavity at t=0, then at time t the current density will be given by $$J=G\,J_s=J_s\,[\delta_1\delta_2(1-T)]^{(\omega t/2\pi)}$$

until space-charge and resonance limit the current. The seed current density can be created by any of several sources including cosmic rays, a thermionic source, ultraviolet light, field emission, a spark, nuclear disintegration, etc. For a very low seed current density a high current density can be achieved in a very short time. For example, if $\delta=8$, T=0.75, and $J_s=14\times10^{-10}$ amps/cm$^2$, at ten rf periods then J=1500 amps/cm$^2$. Note: the remaining interior surface area (i.e. not surface S or the grid) of the cavity in FIG. 3 needs to be coated with a low secondary emitting material such as titanium nitride. This prevents the growth of secondary electrons in unwanted areas.

The yield or secondary emission coefficient of a surface is defined to be the average number of secondary electrons emitted for each incident primary electron. This yield is a function of the incident energy $\epsilon$ of the primary electrons. The secondary emission coefficient $\delta$ for all materials increases at low primary electron energies, reaches a maximum ($\delta_{max}$) at energy $\epsilon_{max}$, and monotonically decreases at high energies (see FIG. 4). The reason for the maximum in the yield curve is this: at increasing energies the primary is able to penetrate more into the material and scatter more electrons; however, at sufficiently high energies the scattered electrons are at a larger depth from the material surface and are increasingly unable to escape from the material. From [D. E. Gray (coord. Ed.), American Institute of Physics Handbook, 3rd Edition, McGraw-Hill] a table can be constructed of commonly used materials with high values of $\delta_{max}$.

TABLE I

| Material | $\delta_{max}$ | $\epsilon_{max}$ (keV) |
|---|---|---|
| GaAs + Cs (crystal) | 500 | (20 kev) |
| MgO (crystal) | 20-25 | (1.5 keV) |
| GaP + Cs (crystal) | 147 | (5.0 keV) |

A Universal Yield Curve [B. K. Agarwal, *Proc. Roy. Soc.* 71, 851 (1958)] good for all materials which describe the number of secondary electrons emitted per primary electron is given by $$\delta = \delta_{max}\frac{2\varepsilon/\varepsilon_{max}}{1+(\varepsilon/\varepsilon_{max})^{1.85(2Z/A)}} \tag{4}$$

where Z and A are the arithmetic mean atomic number and atomic weight, respectively. The secondary emission yield for GaP (plot 1, FIG. 4) at 150 keV from Eq.(4) can be calculated to give δ (150 keV)≈28. This can also be seen from FIG. 4 which shows experimentally verified yield curves for GaP and MgO. For MgO (plot 2, FIG.4) at 20 keV δ (20 keV)≈4.9. At δ=28 and T=0.75 for GaP or δ=4.9 and T=0.75 for MgO, there would be gain since Eq.(1) is satisfied.

High current density secondary emission (>1500 A/cm$^2$) has been achieved with doped silicon that is prepared with cesium [G. G. P. van Gorkom and A. M. E. Hoeberechts, J. Vac. Sci. Tech. B, 4, 108(1986)]. However, the emitting surface is easily contaminated by exposure to $O_2$. GaP+Cs can be used as the secondary emitter for the proposed device at high current densities since it is more robust and not sensitive to $O_2$. Several photomultipliers (RCA C31024, RCA C31050 and RCA 8850 are built with GaP dynodes. The current density limit for GaP is not known as yet, but it is expected to be comparable to the doped silicon since high yield emitters are also high current density emitters. GaAs is another candidate emitter but is sensitive to $O_2$. MgO is a good candidate for low current densities and would have to be applied in a thin layer in order to avoid charge buildup. Another very robust emitter material is diamond film [M. W. Geiss, N. N. Efremow, J. D. Woodhouse, M. D. McAleese, M. Marchywka, D. G. Socker, and J. F. Hochedez, "Diamond Cold Cathode", IEEE Electron Device Letters 12, 8 (1991)]. Single crystal alumina (sapphire) or polycrystalline alumina are also excellent robust emitters. Thin layers need to be applied to avoid charge buildup.

Since the secondary emission process involves electron diffusion to the surface, the emission time will be finite. From a simple diffusion analysis, the emission time for several candidate emitters is several picoseconds. This emission time will limit the maximum cavity frequency. The emission time should be small compared to the rf period in order to not interfere with the resonance process. A frequency of about 15 GHz is an upper bound for the cavity.

To illustrate the effect of finite emission times, ignore space charge in the theoretical model. To achieve resonance with zero delay time, a "primary" electron emitted at a phase ϕ into the rf cycle must reach the opposite electrode so that a "secondary" electron at a phase 180° later [A. J. Hatch, Journal of Applied Physics 32, 1086 (1961)]. The equation of motion of an electron in the cavity is $$d^2x/dt^2=(e/m)E_0\sin\omega t \tag{5}$$

where f=ω/2π is the frequency of the cavity field. The instantaneous position x(t) and velocity dx/dt of the particle is readily solved from Eq.(5) to be $$dz/dt=(eE_0/m\omega)\cos\omega t+C_1 \tag{6}$$

and $$x(t)=-(eE_0/m\omega^2)\sin\omega t+C_1t+C_2 \tag{7}$$

where $C_1$ and $C_2$ are constants of integration. This electron is assumed to originate at the electrode and have an initial velocity $v_0$ at a time wt=ϕ and a final velocity $v_f$ a half-cycle later ωt=σ+ϕ when it reaches the other electrode at x=d. If $V_0$ is the peak applied rf voltage, d the electrode separation, it can easily be shown that resonance can occur if the voltage $V_0$ satisfies $$V_0 = \frac{m\omega^2 d^2}{e}[1 - v_0\pi/\omega d]\Big/\Phi \tag{8}$$

where the quantity Φ is given by $$\Phi(\phi)=\pi\cos\phi+2\sin\phi \tag{9}$$

Note that Φ has a maximum value which gives rise to a minimum resonance condition. At the minimum resonance condition the phase angle ϕ is about 32.5°.

If a finite delay time is now included, Eq.(5) must be solved so that if it takes $t_s$ seconds for the secondary electron to be emitted, the primary must reach x=d at a time ωt=ϕ+π−ω$t_s$. Then, $$v_f = v_0 + \left(\frac{eE_0}{m\omega}\cos\phi + \left(\frac{eE_0}{m\omega}\right)\cos(\phi - \omega t_s)\right. \tag{10}$$

where the conditions at the opposite electrode x=d are now dx/dt=$v_f$ and ωt=ϕ−ω$t_s$+π. This gives $$d = (\pi/\omega - t_s)v_0 + \frac{eE_0}{m\omega^2}[(\pi - \omega t_s)\cos\phi + \sin\phi + \sin(\phi - \omega t_s)] \tag{11}$$

The resonant voltage $V_0$ can be determined from the above equation to be $$V_0 = \frac{m\omega^2 d^2}{e}\frac{1-(\pi/\omega - t_s)(v_0/d)}{(\pi - \omega t_s)\cos\phi + \sin\phi + \sin(\phi - \omega t_s)} \tag{12}$$

which is the analogue of the resonance condition Eq.(8) for finite secondary emission times. In the limit that the time between primary impact and secondary emission is much less than the rf frequency, $\omega t_s \rightarrow 0$ (or more exactly $\omega t_s \ll \phi$), result for resonance without a delay time is recovered. Specifically, for a delay time of 5 ps [P. T. Farnsworth, J. Franklin Institute, 218, 411 (1934)] and phase angle $\phi \approx 0.5$ radians, the frequency should satisfy f<15.9 GHz.

3.4.3 Emittance and Oblique Secondary Emission

Not all secondary electrons are emitted normal to the electrode surface but in fact follow an angular distribution which is nearly independent of the angle of incidence of the primary electrons. This angular distribution comes from secondary electron scattering in the material which ends up as emittance in the beam. The angular distribution of secondary electrons has been studied and it was found that secondary electrons follow an angular distribution according to a $\cos^2\theta$ law which is nearly independent of the angle of incidence of the primary electrons [J. L. H. Jonker, Philips Research Repts. 12, 249 (1957)]. From the $\cos^2\theta$ law one can obtain a simple table detailing the relative number of secondaries emitted at an angle $\theta$.

The secondary yield does depend on the angle of incidence. This can be understood as follows. If the depth of penetration of a primary electron at normal incidence is $x_m$, then the depth of penetration of a primary electron with an angle of incidence (with respect to the surface normal) is approximately $x_m \cos\theta$. Hence, not only may the primary electron traverse a greater distance in the material but the depth of penetration below the surface is less than $x_m$ so that fewer secondary electrons are absorbed by the material. This increase in the secondary emission yield can be analyzed quantitatively. Let the yield $\delta_0$ for normal primary incidence vary as $$\delta_0 = \Delta exp(-\alpha x_m) \tag{13}$$

where $\alpha$ is the fraction of electrons absorbed in the material per depth of penetration and $\Delta$ is the maximum yield. At an oblique angle $\theta$ of incidence then $$\delta_\theta = \Delta exp(-\alpha x_m \cos\theta) \tag{14}$$

Combining the previous two equations the following relation describing the yield for oblique incidence is obtained $$\delta_\theta/\delta_0 = exp[\alpha x_m(1-\cos\theta)] \tag{15}$$

where $\delta_0$ is the yield for a primary at normal incidence $\theta=\pi/2$. Hence for oblique incidence of the primary beam there is an increase in secondary yield. This becomes noticeable for primary energies $\epsilon > \epsilon_{max}$.

The probability for a secondary electron to be emitted between the angles $-\beta$ and $\beta$ can be derived from the $\cos^2\theta$ law as $$P_\beta = \frac{\int_{-\beta}^{\beta} \cos^2\theta \, d\theta}{\int_{-\pi}^{\pi} \cos^2\theta \, d\theta} \tag{16}$$

The results can be tabulated as follows:

TABLE 2

Probability for secondary electron emission at a given angle.

| emission angle | probability |
|---|---|
| $0 < \lvert\theta\rvert < 5$ | 11% |
| $5 < \lvert\theta\rvert < 15$ | 21.5% |
| $15 < \lvert\theta\rvert < 45$ | 49% |
| $45 < \lvert\theta\rvert < 75$ | 17.5% |
| $75 < \lvert\theta\rvert < 90$ | 1% |

Now, an estimate of the normalized emittance can be obtained from the following expression, $$\epsilon_n = 2r_b(kT_t/mc^2)^{1/2} \tag{17}$$

where $kT_t$ represents the average transverse kinetic energy, $r_b$ the beam radius and $mc^2$ the electron rest mass energy. The secondary electron energy distribution typically has a spread of the order of an eV. Taking $r_b$=0.5 cm, and since most of the particles come out at ~300 then $kT_t$ is about 0.25 eV. From Eq.(17) the normalized emittance is 7 mm-mrad. This emittance is comparable to that achieved from thermionic emitters. The resonant secondary electrons become the primary electrons when they strike the opposite cavity wall. Since the angular distribution or emittance of the secondary electrons does not depend on the angle of incidence of the primary electrons then the emittance does not increase on successive periods inside the cavity.

The preceding discussion has focused on the secondary emission yield at a constant temperature-essentially room temperature. However, in high power rf cavities the electrodes become hot. But the effect of an increase in temperature on the secondary emission yield $\delta$ is not important for this application. For metals, where measurements are relatively easy, it has been shown that $\delta$ is constant over a wide range of temperature [G. Blankenfeld, Ann. Physik 9, 48 (1950)]. For alkali halide single crystals and similar insulators, the number of lattice vibrations in the solid increases nearly proportional to the temperature T, so that the range of the primary electron should decrease proportionally. However, this effect is only noticeable for primary energies $\epsilon > \epsilon_{max}$.

There have been a number of careful measurements of secondary emission yield as a function of temperature in the energy range $\epsilon > \epsilon_{max}$. In particular, for MgO, Johnson and McKay [J. B. Johnson and K. G. McKay, Phys. Rev. 91, 582 (1953)] determined that the yield $\delta$ at a temperature of 1013° K only drops by 22% from the yield at a temperature of 298° K. The measurements corresponded to a functional dependence of $T^{-1/2}$. This $T^{-1/2}$ dependence was first postulated by Dekker [A. J. Dekker, Phys. Rev. 94, 1179 (1954)] and has also been corroborated by Shuylman and Dementyev [A. R Shuylman and B. P. Dementyev, Sov. J.Tech. Phys. 25, 2256 (1955)] for KCL, KI, and KBr, and also by Petzel [Petzel, Ph.D. thesis, Dresden (1958)].

Now, solving self-consistently for the steady state or saturation current density for a beam (charge slab) that is already "bunched", the model for this analysis is shown in FIG. 5. The axial electron bunch length 11 or charge slab thickness is $\Delta$, the axial gap spacing between the parallel plates or electrodes 14 is d, and the beam density is n. The equations of motion for electrons "attached" to the front ("f") (label 3 in FIG. 5) and back ("b") (label 1 in FIG. 5 of the charge slab are evaluated. An electron in the center of the bunch (label 2 in FIG. 5) would have no space charge and travel according to Eq. (5). The equations of motion are $$\frac{d^2 x_{f,b}}{dt^2} = (e/m)[E_0 \sin\omega t \pm E_{sc}] \tag{18}$$

with initial conditions $v_{f0}(t=t_{f0})$, $v_{b0}(t=t_{b0})$, $x_{f0}$, $x_{f0}(t=t_{f0})$, $x_{b0}(t=t_{b0})=0$. The subscripts f and b refer to the front and back electrons and the top and bottom sign in Eq. (18), respectively. The quantities $E_0$ and $E_{sc}$ are the magnitudes of the rf and space charge electric fields, respectively. Define the parameters $$\alpha_0 = \frac{eE_0}{m\omega^2 d} \text{ and } \alpha_s = \frac{eE_{sc}}{m\omega^2 d} \tag{19}$$

where $E_{sc}=ne\Delta/2\epsilon_0$ and $\epsilon_0$ is the permittivity of free space. Then the solution of Eq. (18) is for velocity $$\frac{\dot{x}_{f,b}}{\omega d} = \frac{v_{f0,b0}}{\omega d} + \alpha_0[\cos\theta_{f,b} - \cos\theta] \pm \alpha_s(\theta - \theta_{f,b}) \tag{20}$$

and for position $$\frac{x_{f,b}}{d} = \frac{x_{f0,b0}}{d} + \frac{v_{f0,b0}}{\omega d}(\theta - \theta_{f,b}) + \alpha_0[\sin\theta_{f,b} - \sin\theta + \cos\theta_{f,b}(\theta - \theta_{f,b})] \pm \frac{\alpha_s}{2}(\theta - \theta_{f,b})^2 \text{ where } \theta = \omega t,\ \theta_f = \omega t_{f0}, \text{ and } \theta_b = \omega t_{b0}. \tag{21}$$

At resonance when $\theta=\theta_{f,b}+\pi$, the particles must cross the gap, or $x_f=d$ and $x_b=d-x_{f0}$. Assume that $v_{f0}=v_{b0}=0$ so that the following expression is obtained $$\theta_{f,b} = \phi - \arccos\left[\frac{1 \mp \alpha_s(\pi^2/2) - (x_{f0}/d)}{\alpha_0(\pi^2 + 2^2)^{1/2}}\right] \tag{22}$$

where $\phi=\arctan(2/\pi)$

Consider $\theta_b$ and theref ore the positive quantity in brackets in Eq. (22). If the space charge parameter $\alpha_s$ is increased with all other parameters fixed, the back electron will go out of resonance when the quantity in brackets exceeds one. Thus to maintain resonance and the maximum space charge the following equation must be satisfied $$\alpha_{s,\max} = \frac{2}{\pi^2}\left[\alpha_0(\pi^2 + 2^2)^{1/2} - 1 + \frac{x_{f0}}{d}\right] \tag{23}$$

Note that in Eq.(23) there is a minimum value of $\alpha_0$ where space charge cannot be supported, i.e., when $\alpha_s=0$. This occurs at $$\alpha_{0,\min} = \frac{1 - x_{f0}/d}{(\pi^2 + 2^2)^{1/2}} \tag{24}$$

The peak steady-state current density can be calculated from the expression J=nev and Eqs.(19), (20), (22), and (23). The result is $$\frac{J}{J_0} = \alpha_s \frac{2\alpha_0 \cos\theta_f + \pi\alpha_s}{(\Delta/d)_{FWHM}} \tag{25}$$

where $$J_0 = \epsilon_0 \frac{m}{e}\omega^3 d \tag{26}$$

As will be seen in the section describing the PIC simulations, the $\omega^3$ scaling to the saturated current derived above is an important scaling law for the micropulse gun. This scaling is also derivable from the time-dependent current-voltage relation in a diode first derived by Kadish, Peter, and Jones [A. Kadish, W. Peter, and M. E. Jones, Appl. Phys. Lett. 47, 115 (1985)]:

$$j(0, t) \sim -\frac{\varepsilon_0}{d}\frac{dV}{dt} \tag{27}$$

where d is the gap length, V(t) is the (time-dependent) voltage at the opposite electrode, and j(0,t) is the current density at the source. Since $dV/dt=V_0\omega\cos\omega t$, and $V_0 \sim \omega^2$ (Eq.19), we find from the above equation that the current density scaling is indeed $\propto\omega^3$.

It will be seen shortly that Eq.(25) only depends on the drive parameter $\alpha_0$. The fact has been used that the current density pulse shape is approximately triangular in the PIC simulation so that $(\Delta/d)=2(\Delta/d)_{FWHM}$. The FWHM thickness will be used later for making comparisons with the PIC simulation results. Next, the expression for $(\Delta/d)_{FWHM}$ needs to be calculated. The charge slab thickness or bunched length is average over the gap spacing since from the outset the average thickness is used to evaluate the space charge electric field and the equation of motion.

$$\left(\frac{\Delta}{d}\right)_{FWHM} = \frac{1}{2}\frac{\int_{\theta_b}^{\theta_f+\pi}\left(\frac{x_f}{d} - \frac{x_b}{d}\right)d\theta}{\theta_f - \theta_b + \pi} \tag{28}$$

After evaluating Eq. (28) above $$\left(\frac{\Delta}{d}\right)_{FWHM} = \frac{\alpha_0}{2}\left[\sin\theta_f - \sin\theta_b + \frac{1}{2}\cos\theta_f(\theta_b - \theta_f + \pi) - \frac{1}{2}\cos\theta_b(\theta_f - \theta_b + \pi)\right] + \frac{\alpha_s}{12}\left[(\theta_f - \theta_b + \pi)^2 + \frac{\pi^3 + (\theta_f - \theta_b)^3}{\theta_f - \theta_b + \pi}\right] + \frac{x_{f0}}{2d} \tag{29}$$

Note that if $\alpha_s=0$ then $\theta_f=\theta_b$ and $(\Delta/d)_{FWHM}=x_{f0}/2d$, as it should.

Equations (25) (plot 1) and (29) (plot 2) are plotted in FIG. 6 as functions of the normalized rf field $\alpha_0$. The initial position $x_{f0}/d$ is taken to be 0.03 which is consistent with the PIC simulation. The bunch length increases rapidly and then saturates at about 11% of the cavity spacing. The normalized steady-state current density rises approximately linearly with $\alpha_0$. This plot of the current density represents the "tuning curve" for this device since $\alpha_0$ depends on the cavity voltage ($V_0$), the cavity gap (d), and frequency ($\omega$). A very tolerant tuning curve is a key result. Even if the electric field changed by 30% from, say, beam loading, resonance would stilloccur but at a lower current density. The range of $\alpha_0$ plotted represents the approximate range of validity for this simple model. Relativistic effects limit the range of validity for the theoretical model. If the resonant voltage $V_0$ exceeds 150 kV then relativistic effects start to become more important and the model begins to break down. The model will need to be generalized to include relativistic effects.

It is important to estimate the likelihood of electrical breakdown in the MPG. Kilpatrick's criterion [W. D. Kilpatrick, Rev. Sci. Inst. 28, 824 (1957)] is based phenomelogically on electrical breakdown due to secondary electron emission from ion bombardment and can be written in the form $$f=1.64E^2exp(-8.5/E) \tag{30}$$

where f is in MHz and E is the MV/meter. Enhancement due to the use of grid wires has not been included. However, because of advances in the cleaning and conditioning of surfaces, and also because of better vacuum techniques which produce high vacuum without the introduction of contaminants (e.g., diffusion pump oil, etc.), Kilpatrick's criterion overestimates the likelihood of breakdown by a factor of two or three for cw [R. A. Jameson, "RF Breakdown Limits," in *High-Brightness Accelerators*, Plenum Press, 1988, p. 497] and five to six for short pulses [S. O. Schriber, Proc 1986 Linear Accelerator Conference, Jun. 2-6, 1986]. Hence, cavities operating at frequencies above Eq. (30) should be very safe from breakdown. For a cavity operating at 1.3 GHz, the critical electric field is ≈32 MV/meter. This is easily satisfied for a micropulse gun with gap lengths between 0.5 and 2.0 cm.

In FIG. 7 a plot is shown of the resonant electric field (plot 1, d=0.5 cm, plot 2, d=1.0 cm and plot 3, d=1.5 cm) for a number of gap lengths and the Kilpatrick breakdown electric field as a function of rf frequency.

It may be advantageous to inhibit particle resonance on parts of the cavity where emission is not desired. In this case, various cavity coatings of carbon-based films made from pyrolitic graphite or lamp black can be employed. Additionally, carefully applied surface coatings have been shown to reduce secondary emission and also to isolate electrical whiskers from the cavity and serve as a trap for slow electrons [W. Peter, Journal of Applied Physics 56, 1546 (1984)]. A titanium nitride has been shown to reduce substantially secondary emission.

The numerical calculations were done with the FMT-developed special secondary emission code FMTSEC, where FMTSEC is defined as a particle-in-cell computer simulation code capable of handling secondary emission. It is a completely self-consistent two-dimensional relativistic particle-in-cell code which treats Cartesian (x-y), cylindrical (r-z), and polar (r-θ) geometries. The field solving algorithm leapfrogs the electromagnetic fields on a staggered mesh and solves Gauss' law by diffusing away numerical errors arising from the particle-to-grid apportionment (i.e., Marder's algorithm [B. Marder, Journal of Computational Physics, 68, 48 (1987)]). The particle pusher is a Runge-Kutta second-order accurate algorithm. The charge accumulation scheme is area weighting. Graphics are done by post-processing, and dump files corresponding to values of the electric field and current density at specific points within the gun are generated.

In a typical run, two electrodes separated by a distance d (e.g., 0.5-2.0 cm) have a periodic voltage $V=V_0 \sin\omega t$ impressed. Electrons are field-emitted from one electrode during the first half-cycle of the rf field to provide the seed electrons for the current amplification to take place. The charge is emitted from a small area that is centered in the electrode. During the first half cycle, electrons are field-emitted to provide a seed of particles. When the seed electrons are accelerated into the second electrode at x=d they are absorbed at this electrode. At this point, a simple surface physics package is implemented in the simulation: If the incident primary electron energy is less than e.g., 20 eV, or greater than e.g., 200 keV, no secondary electrons are liberated. If the incident primary electron energy is within the range e.g., 20 eV<ϵ<200 keV then a little over one secondary electron, δ=1.1, is emitted. This number of secondaries is far below the usual number of secondary electrons liberated per primary impact, but it was a necessary condition in order to keep the numerical computations manageable. These electrons are then reaccelerated into the opposite electrode to generate more electrons, thus creating a cascade of particles.

For these runs, it was assumed that the emission velocity of each secondary electron was a Maxwell in distribution centered around $v_0$. Current density and electric field data are saved from probes inserted near the surface of one of the electrodes and also in the center of the electrode. Those electrons which have reached the opposite electrode have usually been emitted within a range of phases $\phi_1<\phi<\phi_2$. Hence, the electrons participating in the current amplification are actually bunched in the gap region, and in fact the large charge densities of the electron current are limited to a "bunch" emitted between the phases $\phi_1$ and $\phi_2$. This evidently enables a larger current density to exist in the gap region, as the numerical simulations show. Such a phenomena has been demonstrated theoretically in FIG. 6.

Numerical parameters in the code were typically a grid of 2000 cells with numbers of particles typically in the tens of thousands. The actual number of particles per cell was actually larger than the ratio of total number of particles to the total number of cells since emission was allowed only over the central (~5 cells wide) portion of the cavity surfaces.

FIG. 8 shows a series of snapshots in configuration space of the rapid phase bunching of electrons in the cavity. At t=0 electrons are field emitted off the electrode at x=0; they then form a continuous distribution of particles inside the gap before the field emission is turned off at $t=\pi/\omega$. Note that electrons are only emitted from those cells in the center of the cavity in the simulation. At a time t≈0.335 ns (plot 1), the cavity is filled with a large number of particles and no "bunching" is seen; a short time later, at a time t=0.636 ns (plot 2), the broad distribution of particles have diminished, and a thin bunch of particles can be seen within the cavity. Only those particles which strike the opposite electrode at the right phase and velocity can provide additional electrons (which in turn make their way to the original electrode and continue amplification in the number of particles). At a time of t=2.462 ns (plot 3), particles with the "wrong" phase have been filtered out of the simulation, and only particles with the "right" phase are present. The broad distribution of particles have vanished and a narrow bunch of electrons remains and continues to amplify in density. Finally, at a time t=3.35 ns (plot 4), the narrow bunch has expanded from space charge and reached a steady state current density. In a laboratory experiment, there will always be a small distribution of electrons with the wrong phase even at late times, since there are many orders of magnitude more particles in a real experiment.

FIG. 9 shows a plot of the current density $J_x$ across the gap (d=0.5 cm) as a function of time for a simulation with an rf frequency of 1.3 GHz and a voltage amplitude of 4.3 kV. The current density is measured near the second (right-hand) electrode (20, 24 in FIG. 3) which, in an actual experiment, would be the exit screen or grid. Hence, this is the current pulse which will exit the device. The top trace corresponding to positive current density is that current which is emitted from the second (right-hand) electrode and propagates back to the first electrode. The bottom trace (negative current density) describes the beam that would leave the cavity. Both halves of the curve are not symmetric about $J_x=0$ because the beam pulses have substantially different charge densities and velocities when they cross the position of the probe. In the case for which the current density is positive (i.e., electrons are propagating in the negative x direction), the electrons have just been emitted from the electrode and form a highly dense bunch at a relatively low energy. In the case for which the current density is negative (i.e., electrons are propagating in the positive x direction), the electrons have already crossed the gap and are at a relatively high energy and have spread somewhat due to space charge effects. In this case, the simulation ran out to a total of 9 ns and reached a peak amplitude of 20 A/cm$^2$ for d=0.5 cm before energy conservation problems begin to become important. At a gap length of 1.0 cm, the resulting current density increased to 50 A/cm$^2$ with $\alpha_0=0.453$.

FIG. 10 shows the time evolution of the current density for f=6.4 GHz, $V_0=105.2$ kV and a gap length of 0.5 cm. Note that the current density saturates after about seven periods at a value (for the output current) of about 2.8 kA/cm$^2$.

Run times for FMTSEC are up to 4-5 hours on a Cray Y-MP, and up to a day and a half on an Intel Pentium-based machine. The long run-time of the code indicates both the complicated logic inherent in the secondary emission physics package and the large number of particles present after particle multiplication.

FIG. 11 shows the current multiplication for a simulation with an rf frequency 1.3 GHz and a higher voltage 9.8 kV. The system is not in resonance. It is seen that in this case the current density does not grow and then saturate as in the previous two figures but starts off small and then stops completely. This indicates the importance of the resonance phenomenon in achieving high current densities for the micropulse gun.

It is important to determine the saturated current out of the device as a function of rf frequency. A number of runs at various frequencies were conducted to determine the current density extracted from the device as a function of frequency. In FIG. 12 the results are plotted from a number of simulations for saturated current $J_x$ vs. rf frequency for a cavity with both a 0.5 cm gap (plot 1) length and a 1.0 cm gap (plot 2) length and for $\alpha_0=0.453$. Both curves have the same general shape and both obey a power law with $J_x \approx \omega^{3.1}$. The explanation for this scaling law was discussed above. When the gap spacing in the cavity is increased by a factor of two, it is also necessary to either decrease the frequency by a factor of two, or increase the voltage by a factor of four, in order to ensure cavity resonance.

Simulations were also conducted in which the frequency was varied and then measured the micropulse duration in the saturated state (at the seventh cycle). This is shown in FIG. 13. Plot 1 shows the electron micropulse full width at half maximum (FWHM). Plot 2 shows the electron micropulse full width at the base of the pulse. Note that with increasing frequency the micropulse duration decreases. This is because the half-wavelength for allowable emission provides a "bucket" for the pulse width to fill, and as the wavelength decreases there is less for the pulse width to fill, as expected. Note from the figure that $\tau_{FWHM} \propto 1/\omega$; for the value $\alpha_0=0.453$ the constant of proportionality is 0.046 is calculated. Hence, the beam pulse width found to be typically only 4.6% of the rf period. The fact that the pulse is such a small part of the rf period is the reason for the name "micro-pulse gun" in contrast to the usual rf gun [W. Peter, R. J. Faehl, and M. E. Jones, Particle Accelerators 21, 59 (1987)] where the pulse width is equal to the half-period of the rf wave.

It is important to mention that in accordance with the resonant process, the micropulse width decreases as a function of time until saturation (FIG. 14). Plot 1 is the beam full width at different fr cycles. Plot 2 is the beam full width at half maximum at different rf cycles. This is due to the fact that initially particles with all phases are present in the system, and it is only after a few cycle times that the particles with "wrong" phases are flushed out of the system, while at the same time particles with the "right" phase are amplified in number (cf. FIG. 8). These particles with the right "phase" determine the micro-pulse width, the finite width being due to space-charge forces within the pulse which widens the micro-pulse somewhat (see FIG. 8). A distribution of particles within a narrow phase window can still be resonant since particles that were once out of resonance in a single-particle model can be resonant when space-charge is included. This is because a particle with the "wrong" phase can become resonant if the electric fields acting on the particle are such that the particle reaches the opposite electrode at a time a resonant particle would.

In special regard to the simulations with the 1.0 cm gap, it should be remembered that a change in gap length without a change in frequency or voltage could take the cavity out of resonance. This can also be seen from FIG. 11 which shows the evanescent (in time) current density for a simulation at 1.3 GHz and 9.8 kV. Changing the gap length by a fixed amount is equivalent to changing the driving voltage. If one increases the gap by a factor of two, but also decreases the frequency by the same factor, the cavity should still be in resonance, and the saturated current density should scale as $\omega^3$, as is seen in FIG. 12.

FIG. 15 is a plot of the longitudinal electric field in kV/cm for a simulation of 6.4 GHz and 105 kV at the electrode near the exit grid. The sinusoidal behavior of the field is well-demonstrated in the plot. Note, however, the deviations from the sinusoidal behavior (i.e., the small blips near the top of each curve) which correspond to the influence of the nearby charge bunch on the applied field. Note that the space-charge field does not cancel out the applied field, for otherwise, the total electric field demonstrated in FIG. 15 would go to zero at some time t. This would correspond to space charge limited flow. Another feature of FIG. 15 is the "ratty behavior" of the field for increasing time. This is primarily due to an increasing loss of energy conservation in the code. A good rule of thumb in particle-in-cell codes is to disregard those results obtained for which the deviation in energy conservation is larger than 20%, hence after about ten periods we ignore the results.

FIG. 16 demonstrates the effect of space charge loading more directly since it plots the current density $J_x$ (plot 1) near the exit grid vs. time with the longitudinal electric field (plot 2) vs. time seen in FIG. 15. The "blips" in electric field correspond to the presence of a particle bunch emitted off the exit grid on the way back to the opposite electrode. The micropulse moving toward the exit grid is not seen since it has significantly less charge density (but much larger velocity) than the emitted charge bunch near the exit grid. FIG. 16 demonstrates why the space charge limited emission condition cannot be used in our theoretical treatment.

To estimate the frequency shift Δf in the cavity due to beam loading consider $$\frac{\Delta f}{f} = \frac{\Delta U_B - \Delta U_E}{U} \tag{31}$$

and $\Delta U_E$ is the change in electric field energy, $\Delta U_B$ is the change in magnetic field energy, and U is the stored energy in the cavity.

For a solid beam of radius $r_b$ in a cavity of radius R, and under the extreme condition where the beam completely excludes the electric field, the frequency shift is $$\frac{\Delta f}{f} = \frac{[J_0^2(x_{0m}r_b/R) + J_1^2(r_b x_{0m}/R)]}{J_1^2(x_{0m}}\left(\frac{r_b}{R}\right)^2\left(\frac{\Delta}{d}\right) \tag{32}$$

for a small beam radius, $r_b \ll R$, $$\frac{\Delta f}{f} \approx \left(2\frac{r_b}{R}\right)^2\left(\frac{\Delta}{d}\right) \tag{33}$$

For $r_b$=1 cm, Δ/d=0.1, and R=8.83 cm (i.e., 1.3 GHz).

$$\frac{\Delta f}{f} \approx 5\times 10^{-3} \tag{34}$$

This is not a significant frequency shift. From the tuning curve we could easily tolerate a 10% frequency shift. A similar result can be obtained for a hollow beam.

In FIG. 17, the "resonant tuning curve" is plotted for the micro-pulse electron gun from the PIC simulations and the theoretical prediction. The importance of this plot is the fact that it describes the "tolerance" of the MPG to deviations in cavity voltage, gap spacing, or frequency, and it indicates the striking agreement between theory and PIC simulation. For simulations with a cavity gap length d=0.5 cm the peak current density is plotted for various frequencies as a function of the normalized rf field $\alpha_0$. FIG. 17 suggests that the MPG has a high tolerance, and that errors in the field or gap spacing can be easily accommodated in the resonance process. For instance, as is seen from Table 3 at a frequency of 1.3 GHz, the current density $J_x$ at an applied voltage of 2.4 kV is an order of magnitude less than it is at 4.3 kV. However, $J_x$ climbs rapidly from this value as the voltage approaches 6.4 kV, and then turns over and goes to zero again at 9.8 kV. Also displayed in FIG. 17 is the theoretical tuning curve obtained from Eq. (25). As can be seen, the agreement between theory and the two-dimensional PIC simulations is excellent. At high $\alpha_0$ such that $\alpha_0$>0.6 the analytic theory is suspect since it does not include relativistic effects.

TABLE 3

Current densities at exit grid for cavity at 1.3 GHz.

| voltage (kV) | $J_x$ (kA/cm$^2$) |
|---|---|
| 2.4 | 0.0026 |
| 2.8 | 0.008 |
| 4.3 | 0.02 |
| 6.4 | 0.04 |
| 9.8 | 0.0 |

In FIG. 18, simulation results are plotted for the peak current density $J_x$ (kA/cm$^2$) versus frequency for a series of simulations with gap length 0.5 cm and drive parameter $\alpha_0$=0.453. For comparison, the theoretical curve for $J_x$ vs. frequency from the theory in Section 3.5.1 is also plotted. Again note the excellent agreement between theory and simulation. The $\omega^3$ scaling for the MPG provides an important characterization of the proposed device. Note that the rf voltage is increasing proportionally to $\omega^2$ to maintain a fixed $\alpha_0$.

2-½ dimensional particle-in-cell simulations were conducted to set up a cavity mode in the cavity, including the time-dependent transport of the micropulse by means of a fully relativistic and electromagnetic PIC code. The code does not include secondary emission, but can handle general conducting boundaries, wave launching, and other features. It uses nearest grid point (NGP) accumulation to accumulate the charge and currents, and employs a charge-conserving algorithm.

FIG. 19 shows the side view of a cylindrical symmetric coaxial transmission line and cavity. In this configuration, an rf wave is launched into the end of the coaxial line. If reflected waves are returned to the launch point they are absorbed. The launched wave travels to the entrance of the cavity (where reflections can occur) then the wave travels from the perimeter of the cavity towards the center of the cavity. After arriving at the center, a reflection occurs which returns to the coaxial launch point. Note that by symmetrical feeding power from the perimeter of the cavity, the wave amplitude will be increased when it arrives at the cavity center since the impedance increases. This power feed arrangement acts like a voltage step up transformer.

FIG. 20 shows the resulting voltages for a $TM_{010}$ cavity at 1.275 GHz (9 cm radius) with a d=1 cm cavity gap and coaxial gap of one cm, as discussed above. The voltage as a function of time for both the launch point and the center of the cavity are shown. If the electric field at a specific time is plotted at different radial positions then the mode pattern can be seen. This is done in FIG. 21 and compared to the exact solution for a closed cavity. Excellent agreement is obtained. It can also be seen that the coaxial feed does not disturb the field pattern, except in the unimportant region where the feed connects to the cavity.

In FIG. 22 the same electric field is shown for the above cavity except a 1 cm diameter, 40 amp/cm$^2$, 25 ps long beam is emitted into the cavity. The space charge of the beam decreases the driving electric field by about ⅓. This beam loading, as discussed previously with regard to the tuning curve, does not significantly alter the resonance.

A result for setting up the $TM_{020}$ mode can be obtained which is similar to the $TM_{010}$ mode. FIG. 23 shows the result of plotting the axial electric field as a function of radius. The simulation result is then compared to the exact solution for a closed cavity. Again excellent agreement is obtained. For purposes of efficiency and for breakdown problems, it is advisable to zero out the first peak of the Bessel function for $TM_{020}$. This can be done by placing a conducting cylinder with radius equal to the first zero of the $TM_{020}$ mode. In this configuration, the rf generator does not need to provide energy to drive the first peak of the $TM_{020}$ mode for launching the hollow beam. FIG. 24 shows the axial electric field as a function of radius. The first peak has clearly been eliminated. In FIG. 25 we show the axial electric field as a function of radius loaded down by a 40 amp/cm$^2$, 25 ps pulse, and one cm diameter electron beam. The space charge loading is about ⅓ of the peak electric field.

Simulations with our 2-½ dimensional PIC code (without secondary emission) were conducted in order to determine the emittance growth in the cavity and after extraction of a micro-pulsed electron beam. The results were compared with dc and ac applied voltage the cavity. In the simulations, the rf frequency in the cavity was about 1.3 GHz, and the injected pulse had a 20 ps width in accordance with the results of the FMTSEC code. The injected current density was 40 amps/cm$^2$ (cf. Table 3) and the initial emittance was assumed zero. Beam emittance was then measured before both grids, after the first grid, and after the second grid.

In FIG. 26, a plot is shown of the emittance in mm-mrad vs. the number of grid wires in the simulation, and for two grid wire diameters. Also the corresponding transmission is shown. For these results a dc voltage was applied to the cavity along with a 10 kG axial magnetic field. The geometry is similar to FIG. 3 with d=1.0 cm, $V_0$=17.2 kV (dc) and an accelerating field of 17.2 kV/cm was applied outside the second grid. As the number of wires or their diameter increase, the transmission ratio goes down. However, so does the emittance. For instance, for 4 grid wires of radius 0.096 mm a transmission efficiency of close to 85% and an emittance of 30 mm-mrad was obtained; if the radius of each wire is larger we have a smaller transmission of close to 70% but a better emittance of 20 mm-mrad. The better emittance is due to the fact that the field lines are less "concentrated" around the larger-radius wire and thus provide less "kick" to the electrons leaving the cavity.

The wire spacing in the simulations was small compared to the spacing between grids. The field in between grids decreased by four orders of magnitude; thus field leakage was negligible.

In the cavity, the rf electric field curves near the screen or grid wires which increases the emittance of the beam by giving electrons a transverse kick. This transverse kick can be substantially reduced by using grid wires that are close together. However, by closing the gap between wires the transmission efficiency will decrease. These studies have shown that the transverse "kick" that the electron sees going into the first grid is substantially smaller than anticipated. The key reason that the transverse electric field is small is that the beam particles enter an accelerating field at a phase between zero and 50°. The beam arrives at the screen $\pi/\omega$ later when the electric field is low (between zero to one-half of the peak value. This is a big advantage for the MPG as compared to a dc gun which exposes electrons to the maximum field. The emittance is about a factor of two lower when the dc and ac results are compared.

There is an advantage in using two grids since this arrangement allows isolation between the high energy electric field and the cavity electric field. This prevents non-resonant electrons in the cavity from being drawn into the accelerating region.

The accelerating field (after the cavity and second grid) produces a transverse kick as the electrons pass the second grid. However, this field is substantially reduced when we introduce an electrode which makes an angle of 45° with the beam exiting the grid. Only the bottom of this 45° electrode is shown in FIG. 27. The introduction of this electrode is to focus the micro-pulse (see FIGS. 30 and 31); the angle of 45° is optional for high energy electrons [W. Peter, Journal of Applied Physics 71, 3197 (1992)]. For emission, this angle becomes $3\pi/8$, that is, the Pierce angle. The fact that this 45° electrode will reduce the transverse fields by an order of magnitude is a fortunate outcome of our studies. This also allows for higher gradients outside the cavity. Thus, the kick from the second grid does not significantly affect the emittance.

FIG. 27 shows the configuration space and phase space for a solid beam of about 3 nC. A constant magnetic field of 10 kG was applied. The gap spacing is 1 cm and $V_0$=17.2 kV. An accelerating field of 70 kV/cm is used outside the cavity and after the second grid. The beam before the first grid, between grids, and after the second grid is shown along with the corresponding phase space. The emittance is clearly shown to increase after the first grid. But almost no change in emittance is observed between the first and second grid. The discrete beamlet results from the smallest grid that can be simulated. In the real world a much smaller wire radius and spacing can be made. The trend from the dc simulations (FIG. 26) indicates that the emittance can be maintained by decreasing the wire diameter and increasing the number of wires.

FIG. 28 shows the emittance and transmission results using an ac voltage. The normalized emittance starts at zero and grows to 2.5 mm-mrad just before the first grid. The emittance after both grids decreases as the number of grid wires per 5 mm radial extent increases. With reasonable transmission (52%), an emittance within a factor of two of its value before the grid can be obtained. If "rms addition" is applied to the secondary source emittance of 7 mm-mrad and to those on FIG. 28 a range of 9-18 mm-mrad as the final extracted beam emittance is obtained. For the given space charge, the best emittance to charge ratio of 3 mm-mrad/nC is obtained, including all sources of emittance for the extracted beam.

The grid or transmission screen will heat up primarily from electron beam impact. The average power/unit area delivered to the screen is $$P_{avg} = \frac{2}{\pi}(1-T)V_0 J f \tau f_\tau \tau_d$$

where $\tau_d$ and $f_\tau$ are the pulse duration and repetition rate, respectively, and $\tau$ is the FWHM of the current pulse. If T=75%, f=6.4 GHz, $V_0$=105 keV, $f_\tau$=1 kHz and $\tau_d$=100 ns then $P_{avg}$=210 watts/cm$^2$. This is only 20% of the accepted relievable thermal load.

To estimate the temperature rise assume that the power (Pay,) escapes conductively from the inner to outer radius of the annular screen area. If the screen has a thermal conductivity of K and thermal penetration depth $\Delta t$, then the temperature difference between the inner ($r_1$) and outer ($r_2$) radius is given by:

$$\Delta T_t = \frac{P_{avg}(r_2 - r_1)^2}{2\kappa\Delta t}$$

Here the thermal penetration depth is determined from $\Delta t=\sqrt{12\kappa/\rho C_p}\,t_r$, where ρ is the mass density and $C_p$ is the heat capacity. If the screen is made of tungsten then: κ=1.5 watts/cm-° C., Δt=0.09 cm, $r_2$=3.04 cm, and $r_0$=2.68 cm; then $\Delta T_t$=171°.

The screen will get hot but this temperature is not destructive to the screen near the secondary emitter.

Post-acceleration of the beam which emerges from the micro-pulse gun is required for either the injector or the rf generator application. In principle, post-acceleration can be accomplished using an electrostatic column or using induction cavities, or with rf cavities. The latter two methods have the advantage that the cavities are enclosed and are at ground potential. The choice depends on details of the application, e.g., beam current, pulse duration, cost, and complexity.

Most linac injectors accelerate the beam to a few MeV, typically starting from an e-gun voltage of 100 kV. This brings the beam to a relativistic velocity, and reduces the perveance (hence space charge effects) to a manageable level.

For the microwave generator application it is assumed that post-acceleration would most likely be in the range 0.5 MV to 1 MV, in order to take optimum advantage of the micro-pulse gun. Beam emittance is not as critical as for an injector.

Beam loading must be included in the post-accelerator design. The design in general is relatively conventional.

The equilibrium beam current density can be calculated from an envelope equation written in the following form, $$J = I_A\left[\frac{1}{8\pi}\left(\frac{\Omega_c}{c}\right)^2\right]$$

where $I_A$=17βγ (kA). For the case of 6.4 GHz, $\alpha_0$=0.453, the electron energy is $\epsilon=(2/\pi)eV_0$ where $V_0$=105 kV and $J_x$=2.8 kA/cm$^2$. The required magnetic field is 4.8 kG. This is a tolerable field for a microwave generator.

If the electron current density is too high and the beam's annular thickness (hollow beam) or radius (solid beam) is too large, the electromagnetic field will not penetrate it. From the current density the plasma frequency is found to be greater than the radiation frequency. However, the collisionless skin depth is greater than the radial thickness of the beam; therefore the electromagnetic field will penetrate it. The current limit occurs when the collisionless skin depth equals the radial beam thickness. If this is done the relativistic result for a hollow beam is $I_{ht}=I_0\gamma^3\beta r_h/(2\Delta r)$, where $I_0$=17 kA,β=v/c,$r_h$=mean beam radius and $\Delta r_h$=annular beam thickness. For a solid beam $I_{st}=I_0\gamma^3\beta/4$. For our concept the current limit is about 12.3 kA for a solid beam and 60-300 kA for a hollow beam depending on energy spread (30%-1%). This limit is not restrictive in the parameter regime of interest.

In this section the growth rate of the diocotron instability (an important criterion for studying the stability of hollow beam equilibrium) for the hollow beam we are considering for a microwave generator application is evaluated. The e-folding time is given by $$T_e=(4/\sqrt{4c-b^2})(\Omega_c/\omega_p^2)$$

where $\Omega_c$=eB/m and the geometric factors c and b are expressed in the following form $$b=l\,[(1-(r_1/r_2)^2]+[(r_2/r_c)^{2l}-(r_1/r_2)^{2l}]-(r_1/r_c)^2][1-(r_1/r_c)^{2l}]-[(1-(r_1/r_2)^{2l}][(1-(r_2 \quad (40)$$

and have defined $r_1$, $r_2$, $r_c$ to be the inner and outer beam radii and outer conductor radius respectively and l is the azimuthal mode number. The worst case to consider is for the l=2 mode. For the example parameters: n=6.25×10$^{11}$ cm$^{-3}$ (100 nC/cm$^3$), B=4.5 kG, $r_1$=2.68 cm, $r_2$=3.04 cm and $r_c$=3.09 cm, the e-folding time is about 2 nsec. This e-folding time allows a transport length of meters. This length is suitable for microwave generation.

The axial expansion of a micro-pulse due to either an initial energy spread or due to the axial space charge electric field of the micro-pulse is reviewed. The expansion is examined starting from just outside the rf cavity and through the high energy acceleration region. An approximate expression for the space charge expansion first is derived. The axial Lorentz equation can be written in the following form $$\frac{\partial\beta}{\partial t} = \frac{\alpha_\alpha}{\gamma^3} + \frac{\alpha_{sc}}{\gamma^5}$$

where $\alpha_\alpha=eE_\alpha/mc$ and $\alpha_{sc}=eE_{sc}$Imc. $E_\alpha$ and $E_{sc}$ are the accelerating and space charge electric fields, respectively. Note that $E_{sc}$ is the space charge field in the moving frame of the micro-pulse. The inductive electric field reduction of the space charge electric field is taken into account in Eq. (41) by the additional $\gamma^2$. The equation for the time evolution of the length, s, of the micro-pulse is given by $$\frac{\partial s}{\partial t} = (\beta_c - \beta_f)c$$

where the subscript c refers to the center of the micro-pulse and the subscript f refers to the front or face of the micro-pulse. Define the change in γ from the front to the center of the micro-pulse by $\delta\gamma=\gamma_f-\gamma_c$. Assume that $\delta\gamma/\gamma_c<<1$, $\gamma_c>>1$, $\gamma_f>>1$. From Eqs (41), (42) definition of δγ the following pair of equations are obtained $$\frac{\partial^2 s}{\partial t^2} = \frac{-3c\alpha_\alpha\delta\gamma}{\gamma^4} + \frac{c\alpha_{scf}}{\gamma^5}$$

and $$\frac{\partial}{\partial t}\delta\gamma = \frac{\alpha_{scf}}{\gamma^2}$$

The subscripts on γ have been dropped. Assume that $\gamma=\gamma_0+\alpha_\alpha t$ where $\gamma_0$ is the initial value of γ. Equations (44) and (45) can be solved to yield the final result $$\frac{\Delta s}{s_0} = \frac{1}{6 s_0 \gamma_0^3} \frac{E_{sc}}{E_a}\left(\frac{mc^2}{eE_a}\right) \tag{45}$$

$$\frac{\delta\gamma}{\gamma} = \frac{E_{sc}}{\gamma\gamma_0 E_a} \tag{46}$$

where $\Delta s$, $s_0$ are the change and initial length of the micro-pulse. For the example case at 6.4 GHz, $s_0$=0.0625 cm (full length), $\gamma_0$=1.1, $E_\alpha$=20 MV/m and $E_{sc}$=3 MV/m. The length change is 65% and the energy spread due to space charge 2%. Equation (45) underestimates the spread since the approximations ignore the transition from low velocity, so Equations (41) and (42) as numerically integrated. FIG. 29 shows the expansion of the micro-pulse versus energy. The absolute bunch length and the pulse width are plotted. The bunch length expands from its initial length of 0.625 mm to about 2 mm where it saturates after 2 MeV.

The pulse width decreases from its initial value of 5 psec. Since the acceleration is rapid, once the velocity approaches c the pulse width expands. The bunch length is still increasing, and the pulse width saturates at about 7 psec.

The expansion of the micro-pulse due to an initial energy spread can be calculated by a similar method as outlined above for space charge expansion.

$$\left(\frac{\Delta s}{s_0}\right)_E = \frac{\Delta\gamma}{2 s_0 \gamma_0^2}\left(\frac{mc^2}{eE_a}\right) \tag{47}$$

For the above sample parameters a 16% expansion occurs. Equation (47) also underestimates the expansion for the same reasons as above so again a numerical integration of the equation of motion was performed. The results show that a 44% expansion of the bunch length occurs, however, the pulse width decreases from 5 psec to about 3.5 psec. These results do not have a significant impact on the performance of the device, as demonstrated in the computer simulations.

Upon exiting the cavity, it will be required to focus the micro-pulse. Since the emitting region is not a spherical cathode, and the beam exiting the grid is both high energy and non-space-charge-limited, the typical spherical Pierce electrode shapes cannot be used. As a first approximation, the problem is treated near the beam edge in planar geometry. In this case, because the micro-pulse is both high energy and non-space-charge-limited, the generalization by Peter [W. Peter, Journal of Applied Physics 71, 3197 (1992)] to the usual Pierce electrode shapes is used. FIG. 30 shows a schematic drawing of an electrode geometry which is similar to the usual Pierce shaped electrodes (in planar geometry). The shape is shown in FIG. 30 and is obtained from the functional relation $$x = \left(\frac{3\lambda}{4}\right)\int_0^{\phi} \frac{d\phi}{(9E_0^2\lambda/16 + \phi^{1/2})^{1/2}} \tag{48}$$

where $\lambda \equiv (2e/m)^{1/4}/(9\pi J)^{1/2}$. Integrating this expression gives $\phi$ (x) as a function of x in terms of the following cubic equation $$\xi^3 - 3b\xi + (2b^{3/2} - x/\lambda) = 0 \tag{49}$$

where $b \equiv E_0^2/16\pi J(m/2e)^{1/2}$ and $\xi = (b+\sqrt{\phi})^{1/2}$. Eq.(48) will be solved the physically interesting limit $x/\lambda b^{3/2} >> 1$ which includes the space-charge-limited regime $b \propto E_0^2 \rightarrow 0$. In this limit there is only one real root to Eq. (49), and the equation can be solved by trigonometric methods. The solution can be written in the form $$\phi(x) = \left\{4b\cosh^2\left[\frac{1}{3}\cosh^{-1}\left(\frac{x}{2\lambda b^{3/2}}\right)\right] - b\right\}^2 \tag{50}$$

Expanding Eq.(50) for large $x/\lambda b^{3/2}$ one obtains $$\phi(x) = b^2[(x/\lambda b^{3/2})^{2/3} - 1]^2 \tag{51}$$

In the space-charge-limited case b=0, this equation gives $\phi(x) = (x/\lambda)^{4/3}$ which is Child's Law. An equipotential shape can be derived from Eq.(51) using the relation $V_0 = \mathrm{Re}\,\phi(x+iy)$. This gives with $x+iy = re^{i\theta}$ $$V_0\lambda^{4/3} = r^{4/3}\cos(4\theta/3) - 2r^{2/3}b\lambda^{2/3}\cos(2\theta/3) + b^2\lambda^{4/3}. \tag{52}$$

For space-charge-limited emission, b=0, and Eq.(52) reduces to $$V_0\lambda^{4/3} = r^{4/3}\cos 4\theta/3 \tag{53}$$

For $V_0$=0, the angle $\theta$ becomes the classical Pierce angle $3\pi/8$=67.5°. By solving Eq. (52) for $\rho = \rho(\theta)$ where $\rho = r(2\pi eJ/mc^3)^{1/2}$ is the dimensionless polar coordinate, the electrode shape for $x/\lambda b^{3/2} >> 1$ is determined from the equation $$\rho = \frac{2^{3/4}}{3}\left(\frac{2}{3\nu}\right)\left[\cos\frac{2\theta}{3} + \left(\cos^2\frac{2\theta}{3} - \cos\frac{4\theta}{3}\left[1 - \left(\frac{3\nu}{2}\right)^4\left(\frac{eV_0}{mc^2}\right)\right]\right)^{1/2}\right]^{3/2}\cos^{-3/2}(4\theta/3) \tag{54}$$

where $\nu = 2(mc^2/e)^{1/4}/3\sqrt{b}$ and is usually larger than unity for most experiments. For instance, if the cathode electric field $E_0$ is measured in V/m and the current density J in A/cm$^2$, then $\nu \sim 1.6\times10^6(J^{1/2}/E_0)$. Using the values [J. S. Fraser and R. L. Sheffield, IEEE J. Quantum Elec. QE-23, 1489 (1987); Proc. 9th Int'l FEL Conf., ed. P. Sprangle, C. M. Tang, and J. Walsh, North Holland Publishing, Amsterdam, (1988). R. L. Sheffield, E. R. Gray and J. S. Fraser, p.222; P. J. Tallerico, J. P. Coulon, LA-11189-MS (1988); P. J. Tallerico et al, Linac Proc. 528 (1989)], J=200 A/cm$^2$ and $E_0$=10 MeV/m, one obtains $\nu$=2.2. For smaller electric fields at the cathode $E_0$<MeV, $\nu$ is even larger. Note that for J=200 A/cm$^2$, the normalized coordinate $\xi \sim 0.217x$ for x in cm. The electrode shapes described by Eq. (54) are shown in FIG. 31 for a value of $\nu$=2. Also shown in FIG. 31 are the Pierce shapes for comparison. Note that only for extremely small values of x (or $\xi$) near the origin in FIG. 31, does the approximation $x/\lambda b^{3/2} >> 1$ break down.

For higher voltages, only the anode shaping differs. For non-space-charge-limited "emission" from the gun region, both the cathode and anode shapes will change. This is the case for the micro-pulse gun. In particular the cathode shape will no longer be a cone making the Pierce angle of $3\pi/8$=67.5° with the beam edge. An example is given in FIG. 31 for a 0.5 MV accelerating region with a nonzero electric field of 10 MV/m at the gun exit; a focused geometry like this will be used to focus the micro-pulse leaving the grid.

To determine the required rf power it first must be determined the amount of beam power to be driven. The main variable for the beam power is the amount of current desired. Particle energy, current density, and micro-pulse width are determined by the drive frequency. Then to determine the current the emission area must be specified. However, the desired emission area must be traced against the allowed energy spread. This source of energy spread ΔE/E comes from the radial dependence of the axial electric field (FIG. 32). The $J_0(kr)$ Bessel function has been used to derive area expressions for both the solid and hollow beams. The emission area for a solid beam is $$A_s(\mathrm{cm}^2) \approx \frac{300}{f^2(\mathrm{GHz})}\frac{\Delta E}{E} \tag{55}$$

and for a hollow beam $$A_h(\mathrm{cm}^2) \approx \frac{1562}{f^2(\mathrm{GHz})}\left(\frac{\Delta E}{E}\right)^{1/2} \tag{56}$$

Eq. (55) is plotted in FIG. 33 for different energy spreads. For $\alpha_0$=0.453 the current density is given by $$J(amps/cm^2)=21.25f^3(GHz)d(cm) \tag{57}$$

From this, the current for a solid beam is $$I_s(kA) = 6.38f(\mathrm{GHz})d(\mathrm{cm})\left(\frac{\Delta E}{E}\right) \tag{58}$$

and for a hollow beam is $$I_h(kA) = 33.19f(\mathrm{GHz})d(\mathrm{cm})\left(\frac{\Delta E}{E}\right)^{1/2} \tag{59}$$

The current for a solid beam with $\alpha_0$=0.453, d=0.5 cm, and d=1.0 cm is plotted in FIGS. 34 and 35 for different energy spreads. Thus, currents from 30 amps at a one percent energy spread, 1 GHz, d=0.5 cm and up to 16 kA at 8 GHz, 30% energy spread and d=1.0 cm can be obtained. A final factor to be determined is the amount of charge in a micro-bunch. From the PIC simulation we have determined that the FWHM pulse width is given by $$\tau_{FWHM}(ps) \approx \frac{46.8}{f(\mathrm{GHz})} \text{ for } \alpha_0 = 0.453 \tag{60}$$

The current is a linear function of frequency so that the charge per pulse is independent of frequency.

For a solid and hollow beam the charge per pulse is $$Q_s(nC) = 298d(\mathrm{cm})\left(\frac{\Delta E}{E}\right) \tag{61}$$

and $$Q_h(nC) = 1553d(\mathrm{cm})\left(\frac{\Delta E}{E}\right)^{1/2} \tag{62}$$

FIG. 36 shows the charge per pulse for a solid beam. To achieve~100 nC in a pulse a large energy spread in addition to a large gap spacing is required. FIGS. 37-40 show the emission area, current and charge per pulse for a hollow beam. Currents from 1.5 kA at low frequency and low energy spread to more than 100 kA at high frequency and higher energy spread are possible. Given the huge area available for a hollow beam the charge pulse starts at about 100 nC and increases to more than 100 nC.

The peak transmitted beam current can be calculated from the expression $$I_T = JAT \tag{63}$$

Using the results from Eqs. (58) and (59) then the peak transmitted current for a solid beam is $$I_{Ts}(kA) = 6.38f(\mathrm{GHz})d(\mathrm{cm})\left(\frac{\Delta E}{E}\right)T \tag{64}$$

and for a hollow beam is $$I_{Th}(kA) = 33.19f(GHz)d(\mathrm{cm})\left(\frac{\Delta E}{E}\right)^{1/2}T \tag{65}$$

The peak transmitted beam power can now be calculated using the fact that the peak electron energy is $$\epsilon_p \approx \frac{2}{\pi}eV_0 = \frac{2}{\pi}\alpha_0 m\omega^2 d^2 \tag{66}$$

so that for a solid beam the peak transmitted beam power is $$P_{Ts}(MW) = 41.32f^3(\mathrm{GHz})d^3(\mathrm{cm})\left(\frac{\Delta E}{E}\right)T \tag{67}$$

and for a hollow beam is $$P_{Th}(MW) = 214.9f^3(\mathrm{GHz})d^3(\mathrm{cm})\left(\frac{\Delta E}{E}\right)^{1/2}T \tag{68}$$

The peak rf power required to resonantly drive the beam in the input cavity is given by $$P_{c,peak} = \frac{2}{\pi}V_0 JA \tag{69}$$

where $V_0$ is the resonant cavity voltage, J is the peak steady-state current, and A is the emission area for the beam. For a one centimeter diameter solid beam with $\alpha_0$=0.453, d=0.5 cm, f=6.4 GHz, the peak power is 147 MM in the cavity. If the cavity is fed coaxially as shown in FIG. 2, the input power is about 1/16 of the cavity power. Thus 9.2 MW of peak input power is required. The factor of 16 is due to the fact that the electric field is amplified or transformed in going from the coax input to the cavity. This transform ratio will be different for different modes. It is assumed that an approximate constant transform ratio for both a solid and a hollow beam can be maintained. For a hollow beam the transform ratio power is about 6.5. The peak power in the coaxial transmission line for a solid beam is $$P_{peak,solid}(MW) = 2.58 f^3(\text{GHz}) d^3(\text{cm}) \left(\frac{\Delta E}{E}\right) \alpha_0 = 0.453 \tag{70}$$

and for a hollow beam is $$P_{peak,hollow}(MW) = 33 f^3(\text{GHz}) d^3(\text{cm}) \left(\frac{\Delta E}{E}\right)^{1/2} \alpha_0 = 0.453 \tag{71}$$

Eqs. (70) and (71) are plotted as a function of frequency and energy spread in FIGS. 41-44. The stored energy in the cavity is given by $$U = \frac{J_1^2(x_{0m})}{2} \epsilon_0 (\pi R_m^2 d) E_0^2 \tag{72}$$

where $x_{0m}$ are the zeros of $J_0$ and $R_m$ is the resonant cavity radius for the m-th mode. For f=6.4 GHz, m=2, d=0.5 cm the resonant peak electric field is 210 kV/cm for $\alpha_0$0.453. The stored energy is U=6.06 milli-joules.

Next the Q of the cavity can be estimated from Q=ωU/W, where W is the average rf power lost to both the beam and the resistive wall. It turns out that the wall losses are <1% (for copper walls) of the power delivered to the electron beam. For the example at 6.4 GHz the Q loaded by the beam is Q=7.86.

The fill time for the cavity is calculated from $T_f$=2Q/ω. Again for the 6.4 GHz case the fill time is very short, roughly 2.5 rf periods. Since the fill time is short compared to the current density saturation time the beam current rise time is the current density saturation time which in this case is about 1.5 nanoseconds.

In FIG. 45 a schematic diagram is shown of a power input scheme: a magnetron feeds energy into the rf cavity via a constant impedance tapered coaxial transmission line. Since rf power is fed radially inward from the perimeter of the cavity to the axis and experiences an increasing impedance, the voltage will increase on axis. This scenario is equivalent to a voltage step-up transformer.

For a typical injector application, a finite magnetic field at the emitting surface in the MPG is not used because it would impair the emittance downstream. For this reason, an alternative to magnetic focusing within the MPG is proposed, namely to shape the cavity of the MPG so it employs moderate electrostatic focusing. Classical Pierce shaping cannot be directly used in the present situation since the micropulse from the emitter (FIG. 46) is not space-charge limited. In this case, the appropriate electrode shaping can be solved for from the theory presented for FIGS. 30 and 31. Note that this focusing is essentially "one-way", i.e., the micropulse emitted off the exit grid 20, 24 which returns to the emitting surface S 16 will be slightly de-focused during its transit. However, a slightly de-focused returning pulse can be tolerated since its only raison d'etre is to provide a source of electrons for creation of anew batch of secondary electrons off the surface S 16. Hence, the only possible disadvantage of a de-focused returning micropulse would be to cause some secondary electrons to strike the opposite wall of the cavity outside of S 16 and thus to represent a possible decrease in the cavity Q.

In Table 4 one possible set of design parameters for each of the two major applications is provided.

TABLE 4

One possible set of design parameters for each of the two major applications. Those appended with a (*) have an assumed transmission of 70%, while those denoted with a (**) have an assumed post acceleration of 500 kV.

| Application Configuration | Ingector (Solid Beam) | rf Generator (Hollow Beam) |
|---|---|---|
| Beam Output* | 0.7 kA | 8 kA |
| Beam Charge* | 8 nC | 70 nC |
| Frequency | 4 GHz | 5 GHz |
| Beam Area | 0.7 $cm^2$ | 9 $cm^2$ |
| Cavity Gap | 10 mm | 5 mm |
| Micro-Pulse | 12 ps | 9 ps |
| Required rf Power | 7 MW | 70 MW |
| ΔE/E | 4% | 2% |
| Proposed Harmonic | n/a | x 3 |
| rf Output** | n/a | 2 GW |

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. An electron gun comprising:

an RF cavity having a first side with an electron emitting surface and a second side with an electron transmitting and emitting section; and a mechanism for producing an oscillating force which is applied to the emitting surface and the transmitting and emitting section so electrons are directed between the emitting surface and the transmitting and emitting section, wherein some of said electrons contact the emitting surface to generate additional electrons and said additional electrons contact the transmitting and emitting section to generate further additional electrons or escape the cavity through the transmitting and emitting section, with a resulting gain of electrons in a unidirectional flow after a time t is $[\delta_2\delta_1(1-T)]^{\omega t/2\pi)}$, where $\delta_1$ is the number of secondary electrons emitted from the emitting surface, T is the ratio of transmitted to incident electrons for the transmitting and emitting section, $\delta_2$ is the section electron secondary yield and ω is the radian RF frequency.

2. A gun as described in claim 1 wherein said transmitting and emitting section isolating the cavity from external forces to the cavity.

3. A gun as described in claim 2 wherein the transmitting and emitting section includes a transmitting and emitting double screen.

4. A gun as described in claim 3 wherein the producing mechanism includes a mechanism for producing an oscillating electric field disposed adjacent the RF cavity that provides the oscillating force and has a radial component that confines the electrons to a region between the double screen and the emitting surface.

5. A gun as described in claim 4 wherein the double screen is of an annular shape.

6. A gun as described in claim 4 including a mechanism for producing a magnetic field disposed adjacent the RF cavity to force the electrons to stay between the double screen and the emitting surface.

7. A method for producing electrons characterized by the steps of:

moving at least a first electron in a first direction;

striking a first area with the first electron;

producing additional electrons at the first area due to at least a first electron;

moving the additional electrons from the first area to a second area; and transmitting the additional electrons through the second area and creating $\delta_2[\delta_1(1-T)]$ secondary electrons due to the additional electrons from the first area striking the second area, $\delta_1$ is the number of secondary electrons emitted from the second area, T is the ratio of transmitted to incident electrons for the second area, and $\delta_2$ is the second area electron secondary yield.

* * * * *